US010303074B2

(12) United States Patent
Yamawaki et al.

(10) Patent No.: US 10,303,074 B2
(45) Date of Patent: May 28, 2019

(54) TONER

(71) Applicant: CANON KABUSHIKI KAISHA, Tokyo (JP)

(72) Inventors: Kentaro Yamawaki, Mishima (JP); Akane Masumoto, Suntou-gun (JP); Tomonori Matsunaga, Suntou-gun (JP); Kunihiko Nakamura, Gotemba (JP); Sara Yoshida, Mishima (JP); Shinsuke Mochizuki, Yokohama (JP); Tsuneyoshi Tominaga, Suntou-gun (JP); Kenta Kamikura, Yokohama (JP); Tsutomu Shimano, Mishima (JP); Toshihiko Katakura, Kashiwa (JP); Shiro Kuroki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/975,305

(22) Filed: May 9, 2018

(65) Prior Publication Data

US 2018/0329327 A1 Nov. 15, 2018

(30) Foreign Application Priority Data

May 15, 2017 (JP) ..... 2017-096504
May 15, 2017 (JP) ..... 2017-096534
May 15, 2017 (JP) ..... 2017-096544

(51) Int. Cl.
*G03G 9/08* (2006.01)
*G03G 9/093* (2006.01)
(Continued)

(52) U.S. Cl.
CPC ..... *G03G 9/09328* (2013.01); *G03G 9/08* (2013.01); *G03G 9/0819* (2013.01); *G03G 9/0821* (2013.01); *G03G 9/0825* (2013.01); *G03G 9/08711* (2013.01); *G03G 9/08755* (2013.01); *G03G 9/08773* (2013.01); *G03G 9/09307* (2013.01); *G03G 9/09342* (2013.01); *G03G 9/09364* (2013.01); *G03G 9/09371* (2013.01); *G03G 9/09392* (2013.01);
(Continued)

(58) Field of Classification Search
CPC ..... G03G 9/09307; G03G 9/09328; G03G 9/0821
USPC ..... 430/110.2, 111.4
See application file for complete search history.

(56) References Cited

U.S. PATENT DOCUMENTS 4,952,476 A 8/1990 Sakashita et al.
4,985,327 A 1/1991 Sakashita et al.
(Continued)

FOREIGN PATENT DOCUMENTS

JP 2010-032596 A 2/2010
JP 2015-045860 A 3/2015
(Continued)

OTHER PUBLICATIONS

U.S. Appl. No. 15/969,318, Tsuneyoshi Tominaga, filed May 2, 2018.
(Continued)

*Primary Examiner* — Mark A Chapman
(74) *Attorney, Agent, or Firm* — Venable LLP

(57) ABSTRACT

A toner comprising a binder resin and a colorant, wherein the toner has a Martens hardness, as measured at a maximum load condition of $2.0\times10^{-4}$ N, of from 200 MPa to 1,100 MPa.

11 Claims, 3 Drawing Sheets

(51) Int. Cl.

| | |
|---|---|
| ***G03G 9/097*** | (2006.01) |
| ***G03G 9/087*** | (2006.01) |
| ***G03G 9/113*** | (2006.01) |
| *G03G 9/083* | (2006.01) |
| *G03G 9/107* | (2006.01) |

(52) U.S. Cl.
CPC ..... *G03G 9/09708* (2013.01); *G03G 9/09783* (2013.01); *G03G 9/1136* (2013.01); *G03G 9/0833* (2013.01); *G03G 9/107* (2013.01)

(56) References Cited

U.S. PATENT DOCUMENTS

| | | | |
|---|---|---|---|
| 5,014,089 | A | 5/1991 | Sakashita et al. |
| 5,202,213 | A | 4/1993 | Nakahara et al. |
| 5,532,101 | A | 7/1996 | Nozawa et al. |
| 5,534,982 | A | 7/1996 | Sakaizawa et al. |
| 5,731,122 | A | 3/1998 | Yoshida et al. |
| 5,774,771 | A | 6/1998 | Kukimoto et al. |
| 5,915,150 | A | 6/1999 | Kukimoto et al. |
| 5,948,584 | A | 9/1999 | Hashimoto et al. |
| 5,998,080 | A | 12/1999 | Ohno et al. |
| 6,214,509 | B1 | 4/2001 | Kasuya et al. |
| 6,300,024 | B1 | 10/2001 | Yusa et al. |
| 6,337,169 | B1 | 1/2002 | Hashimoto et al. |
| 6,696,211 | B2 | 2/2004 | Yoshida et al. |
| 6,806,016 | B2 | 10/2004 | Ohno et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,372,573 | B2 | 2/2013 | Ayaki et al. |
| 8,551,680 | B2 | 10/2013 | Ayaki et al. |
| 8,574,801 | B2 | 11/2013 | Itabashi et al. |
| 8,609,312 | B2 | 12/2013 | Itabashi et al. |
| 8,822,120 | B2 | 9/2014 | Abe et al. |
| 8,828,639 | B2 | 9/2014 | Kamikura et al. |
| 8,986,914 | B2 | 3/2015 | Fujikawa et al. |
| 9,029,056 | B2 | 5/2015 | Kenmoku et al. |
| 9,034,549 | B2 | 5/2015 | Shiotari et al. |
| 9,098,002 | B2 | 8/2015 | Kenmoku et al. |
| 9,098,003 | B2 | 8/2015 | Masumoto et al. |
| 9,158,216 | B2 | 10/2015 | Shinano et al. |
| 9,261,806 | B2 | 2/2016 | Moribe et al. |
| 9,285,697 | B2 | 3/2016 | Fukudome et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,459,547 | B2 | 10/2016 | Terasaki |
| 9,500,972 | B2 | 11/2016 | Tanaka et al. |
| 9,575,424 | B2 | 2/2017 | Nakagawa et al. |
| 9,594,323 | B2 | 3/2017 | Fujikawa et al. |
| 9,599,919 | B2 | 3/2017 | Isono et al. |
| 9,720,340 | B2 | 8/2017 | Tominaga et al. |
| 9,733,583 | B2 | 8/2017 | Kuroki et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,880,478 | B2 | 1/2018 | Shimano et al. |
| 9,897,932 | B2 | 2/2018 | Hotta et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 2001/0018158 | A1 | 8/2001 | Yoshida et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0065174 | A1 | 3/2013 | Itabashi et al. |
| 2015/0037720 | A1 | 2/2015 | Tsuda et al. |
| 2015/0248071 | A1 | 9/2015 | Katsura et al. |
| 2017/0123333 | A1 | 5/2017 | Kuroki et al. |
| 2017/0299972 | A1 | 10/2017 | Tanaka et al. |

FOREIGN PATENT DOCUMENTS

| | | | |
|---|---|---|---|
| JP | 2015-141360 | A | 8/2015 |
| JP | 2016-170345 | A | 9/2016 |

OTHER PUBLICATIONS

U.S. Appl. No. 15/973,661, Kenta Kamikura, filed May 8, 2018.
U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,064, Kunihiko Nakamura, filed May 9, 2018.

TONER

BACKGROUND OF THE INVENTION

Field of the Invention

The present invention relates to toner for developing electrostatic images (electrostatic latent images) used in image-forming methods such as electrophotography and electrostatic printing.

Description of the Related Art

Methods that visualize image information via an electrostatic latent image, e.g., electrophotography, are currently used in a wide variety of fields, and there is demand for improvements in performance, most importantly with regard to higher speeds and higher image qualities. Toner must exhibit a rapid charge rise behavior in order to obtain both higher speeds and higher image qualities at the same time.

Approaches from the toner side to address charge rise have included efforts to develop toner charge control agents and efforts to improve flowability through external additions. Approaches from the process side, on the other hand, have included attempts at charge injection and efforts to increase the friction opportunities with the charge-providing member. Since the main toner charging means is through friction, if the friction resistance of the toner could be improved, additional approaches to charge rise could also be taken from the process side.

Examples in this regard for single-component developers are the regulating blade nip width, the regulating blade material, and the rotation speed of the developing roller. An example for two-component developers is the rate of mixing/stirring with the carrier. In particular, increasing the rotation speed of the developing roller has considerable merit not just from the standpoint of charging, but, because it also enables an increase in the toner laid-on level on paper, increasing the developing roller rotation speed also has considerable merit from the perspective of increasing the image quality, e.g., the tinting strength and color gamut. Thus, a qualitative increase in the friction resistance of the toner is required for increasing the speed and raising the image quality in electrophotography.

With regard to art for increasing the friction resistance of toner, Japanese Patent Application Laid-open No. 2016-170345 discloses art in which, in addition to sharpening the main peak in the molecular weight distribution of the toner, the peak molecular weight is specified and an azo-iron compound is added. In addition, Japanese Patent Application Laid-open No. 2015-141360 discloses a toner for which the hardness of a capsule film is at least 1 N/m and less than 3 N/m and for which a thermosetting resin is incorporated in the capsule material.

SUMMARY OF THE INVENTION

With the art in Japanese Patent Application Laid-open No. 2016-170345, the stress resistance is improved by a favorable control of toner hardness achieved through control of the molecular weight and full width at half maximum of the toner binder, and by bringing about the presence in the surface layer of an azo-iron compound, which is a relatively hard charge control agent. In addition, Japanese Patent Application Laid-open No. 2015-141360 provides a toner with a favorable hardness achieved through the incorporation of a thermosetting resin in the capsule material. In Japanese Patent Application Laid-open No. 2016-170345, the focus is on toner cracking and chipping in single-component developers, while the focus in Japanese Patent Application Laid-open No. 2015-141360 is on melt adhesion in the cleaning section, and each is an excellent art for reducing same. The conventional technical concepts, starting with the preceding, are concepts that seek to provide a toner that is resistant to strong shear. However, even when these technologies are used, it has been found that, depending on the process conditions, there are still instances in which the toner is not durable.

An object of the present invention is to provide a toner that has a much better resistance to friction in the developing section than conventional toners. By doing this, a toner is provided that can support an increase in the degree of freedom in process design in pursuit of higher speeds and higher image qualities and that, even during high-speed continuous printing at high print percentages, exhibits an excellent charge rise and resists the occurrence of streaks and ghosts.

The present invention is a toner comprising a toner particle that contains a binder resin and a colorant, wherein the toner has a Martens hardness, as measured at a maximum load condition of $2.0\times10^{-4}$ N, of from 200 MPa to 1,100 MPa.

The present invention can thus provide a toner that has a much better resistance to friction in the developing section than conventional toners. This makes it possible to increase the degree of freedom in process design in pursuit of higher speeds and higher image qualities. The window for selecting, e.g., an increased regulating blade nip width, an increased rotation speed for the developing roller, and an increase in the carrier mixing/stirring rate, is thus broadened. As a result, a toner can be provided that, even during high-speed continuous printing at high print percentages, exhibits an excellent charge rise and resists the occurrence of streaks and ghosts.

DESCRIPTION OF THE EMBODIMENTS

Figure 1:
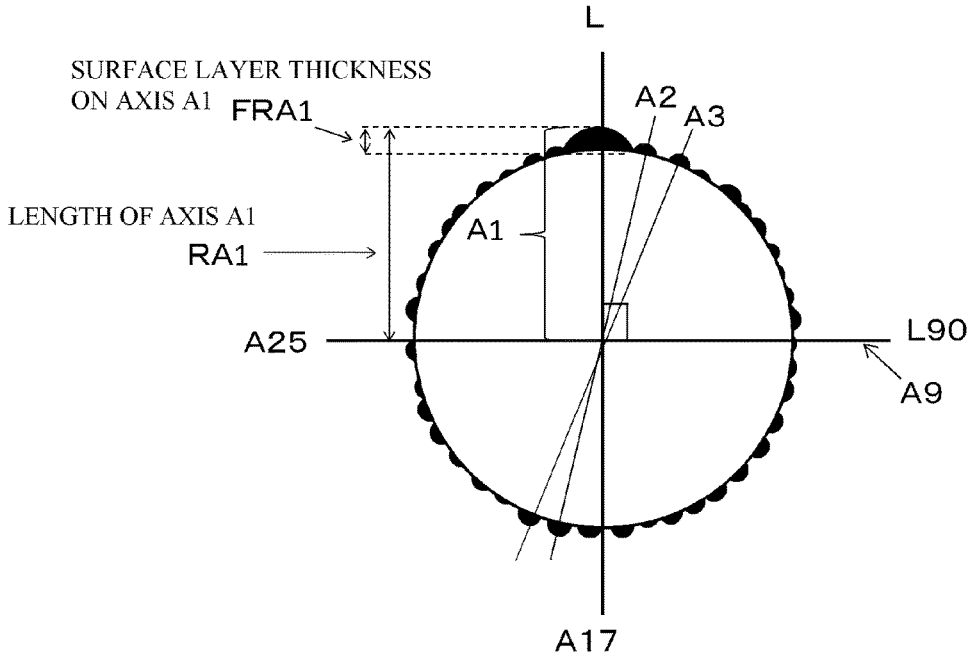
FIG. 1 is a conceptual diagram that defines the surface layer thickness for a surface layer that contains an organosilicon compound.

Unless specifically indicated otherwise, the phrases "from XX to YY" and "XX to YY" that indicate numerical value ranges refer in the present invention to numerical value ranges that include the lower limit and upper limit that are provided as the end points.

As noted above, the conventional technical concepts for raising the friction resistance of toner have been efforts in the direction of providing toner with the ability to withstand strong shear. However, even when these technologies are used, there are instances, depending on the process conditions, in which the toner is not durable. The reasons for this are thought to be as follows.

The shear received by the toner in the developing device is not just strong shear; rather, weak shear is also received through, for example, rubbing with hard materials, e.g., metal members and external additives. While this weak shear due to such rubbing would seem upon cursory consideration to have no influence, it has been found that small alterations, e.g., microscratches, are produced in the toner particle surface when rubbing occurs with materials harder than the toner particle. In addition, this is repeated over and over again when the developing roller rotation speed and/or the developer stirring rate is increased, and eventually the alterations become substantial. It was discovered that in order to prevent the toner alterations resulting from this, a toner design is required that provides resistance not only to strong shear, but also to the very small alterations caused by weak shear.

The toner according to the present invention is a toner having a toner particle that contains a binder resin and a colorant, wherein the toner has a Martens hardness, as measured at a maximum load condition of $2.0\times10^{-4}$ N, of from 200 MPa to 1,100 MPa.

Hardness is a mechanical property of the surface or near surface of an object. It is the difficulty of inducing the deformation of an object or the difficulty of scratching an object when a deformation or a scratch is applied by a foreign material, and various measurement methods and definitions exist. For example, different measurement methods are appropriately used depending on the width of the measurement region, and it is often appropriate to use the Vickers procedure when the measurement region is at least 10 μm, a nanoindentation procedure at 10 μm or less, and an AFM when at 1 μm or less. The following definitions, for example, are used as appropriate: the Brinell hardness and Vickers hardness for indentation hardness; the Martens hardness for scratch hardness; and the Shore hardness for rebound hardness.

For measurements on toner, a nanoindentation procedure is preferably used for the measurement method since the particle diameter is generally 3 μm to 10 μm. According to investigations by the present inventors, the Martens hardness, which gives the scratch hardness, was suitable for specifying the hardness for exhibiting the effects of the present invention. It is thought that this is because the scratch hardness can represent the strength versus the scratching of the toner by hard materials, e.g., metal and external additive, in the developing unit.

With regard to the method for measuring the Martens hardness by a nanoindentation procedure, the Martens hardness can be calculated from the load-displacement curve obtained according to the indentation test procedure stipulated in ISO 14577-1 using a commercial instrument according to ISO 14577-1. An "ENT-1100b" (Elionix Inc.) ultramicroindentation hardness tester is used in the present invention as an instrument that conforms to the indicated ISO standard. The measurement method is described in the "ENT 1100 Operating Manual" supplied with the instrument, and the specific measurement method is as follows.

The measurement environment is maintenance at 30.0° C. within the shield case using the provided temperature controller. Holding the atmospheric temperature constant is effective for reducing the variability in the measurement data caused by, e.g., thermal expansion and drift. The set temperature condition is made 30.0° C., which is assumed to be the temperature in the neighborhood of the developing unit where the toner is subjected to friction. The standard test stand provided with the instrument is used for the test stand. After coating with the toner, a very weak air stream is applied in order to disperse the toner, and the test stand is then set in the instrument and the measurement is performed after holding for at least 1 hour.

For the indenter, the measurement is carried out using a flat indenter (titanium indenter, diamond tip) provided with the instrument and having a 20-μm square plane tip. With small-diameter spherical objects, objects to which an external additive is attached, and objects in which unevenness is present in the surface, such as toners, a flat indenter is used due to the large influence on measurement accuracy when a pointed indenter is used. The tests are carried out with the maximum load set to $2.0\times10^{-4}$ N. By setting to such a test load, the hardness can be measured without rupturing the surface layer of the toner and under conditions that correspond to the stress received by one toner particle in the developing section. Because the friction resistance is crucial to the present invention, it is then critical to measure the hardness with the surface layer being maintained as such without fracture.

For the particle to be measured, a particle where toner is individually present in isolation is selected from the measurement screen (visual field size: horizontal width=160 μm, vertical width=120 μm) using the microscope provided with the instrument. In order to eliminate the error on the amount of displacement to the greatest extent possible, particles are selected having a particle diameter (D) in the range of the number-average particle diameter (D1)±0.5 μm (D1−0.5 μm≤D≤D1+0.5 μm). To measure the particle diameter of a targeted particle, the long diameter and short diameter of the toner were measured using the software provided with the instrument, and [(long diameter+short diameter)/2] was used as the particle diameter D (μm). The number-average particle diameter is measured by the method described below using a "Coulter Counter Multisizer 3" (Beckman Coulter, Inc.).

The measurement is performed by randomly selecting 100 toner particles having a particle diameter D (μm) that satisfies the condition given above. The conditions input for the measurement are as follows.

Test mode: load-unload test
Test load: 20.000 mgf (=$2.0\times10^{-4}$ N)
Number of steps: 1,000 steps
Step interval: 10 msec When "Data Analysis (ISO)" is selected on the analysis menu and the measurement is then performed, after the measurement the Martens hardness is analyzed and output by the software provided with the instrument. This measurement is run on 100 toner particles, and the arithmetic average thereof is used as the Martens hardness in the present invention.

The friction resistance of the toner in the developing section could be substantially increased over that of conventional toner by adjusting the Martens hardness, when the toner was measured under a maximum load condition of $2.0\times10^{-4}$ N, to from 200 MPa to 1,100 MPa. This made it possible to raise the degree of freedom in process design in pursuit of higher speeds and higher image quality.

The window for selecting, e.g., an increased regulating blade nip width, an increased rotation speed for the developing roller, and an increase in the carrier mixing/stirring rate, is thus broadened. As a result, a toner can be provided that, even during high-speed continuous printing at high print percentages, exhibits an excellent charge rise and resists the occurrence of streaks and ghosts.

The effects of the present invention are not satisfactorily obtained when this Martens hardness is lower than 200 MPa. A preferred value is at least 250 MPa, and a more preferred value is at least 300 MPa. When, on the other hand, this Martens hardness is greater than 1,100 MPa, caution must be exercised because, depending on the circumstances, this may also cause scratching of members such as the regulating blade and developing roller. A preferred value is not more than 1,000 MPa, and a more preferred value is not more than 900 MPa.

In addition, the toner according to the present invention preferably has a Martens hardness, as measured at a maximum load condition of $9.8\times10^{-4}$ N, of from 5 MPa to 100 MPa and more preferably from 10 MPa to 80 MPa. This load of $9.8\times10^{-4}$ N is thought to correspond to the shear applied in the cleaning section. When the Martens hardness for this load is in the indicated range, toner slip-through at the cleaning section is then suppressed because the toner has a suitable softness. A toner is thus obtained that has a suitable hardness with respect to the shear corresponding to the developing section and a suitable softness with respect to the shear corresponding to the cleaning section.

Since the technical concept with conventional toners has been resistance to high shear, when a hardness durable to development has been secured, there have naturally been instances in which such a hardness has been harmful in, for example, the cleaning section or fixing section. The toner according to the present invention can take on a suitable hardness in conformity to the shear it receives in each particular step. When the Martens hardness measured at a maximum load condition of $9.8\times10^{-4}$ N is at least 5 MPa, the toner is resistant to breakage at the cleaning blade and as a consequence melt adhesion to the blade is suppressed and the occurrence of faulty cleaning is also suppressed. At 100 MPa and below, on the other hand, a favorable hardness is present and the occurrence of slip-through caused by rolling is suppressed.

The measurement of the Martens hardness at a maximum load condition of $9.8\times10^{-4}$ N is performed using the measurement method at a maximum load condition of $2.0\times10^{-4}$ N, but using $9.8\times10^{-4}$ N for the test load.

The Martens hardness measured at a maximum load condition of $9.8\times10^{-4}$ N can be controlled using, for example, the molecular weight and glass transition temperature Tg of the binder resin present in the toner and the crosslinking regime.

There are no particular limitations on the means for adjusting the Martens hardness measured at a maximum load condition of $2.0\times10^{-4}$ N to from 200 MPa to 1,100 MPa. However, because this hardness is substantially harder than the hardness of the organic resins that are commonly used in toners, it is difficult to achieve using the means commonly implemented in order to raise the hardness. For example, it is difficult to achieve using the means of designing the resin to have a high glass transition temperature, the means of raising the molecular weight of the resin, thermosetting means, the means of adding a filler to the surface layer, and so forth.

The Martens hardness of the organic resins used in common toners, when measured at a maximum load condition of $2.0\times10^{-4}$ N, is approximately 50 MPa to 80 MPa. Moreover, it is approximately not more than 120 MPa even when the hardness has been raised by, for example, resin design or raising the molecular weight. It is approximately not more than 180 MPa even when a filler, i.e., a magnetic body or silica, is filled into the neighborhood of the surface layer and thermosetting is carried out, and thus the toner according to the present invention is substantially harder than common toners.

One means for adjusting into the prescribed hardness range indicated above is, for example, a method in which a toner surface layer is formed with a material, e.g., an inorganic material, having a suitable hardness and in which the chemical structure and macrostructure of the toner surface layer are also controlled so as to have a suitable hardness.

In a specific example, the material capable of assuming the prescribed hardness indicated above is an organosilicon polymer, whereby the hardness can be adjusted through material selection based on, for example, the carbon chain length and the number of carbon atoms directly bonded to the silicon atom in the organosilicon polymer. Adjustment to the prescribed hardness as indicated above is readily achieved when the toner particle has a surface layer containing an organosilicon polymer and the number of carbon atoms directly bonded to the silicon atom in the organosilicon polymer is on average from 1 to 3 (preferably from 1 to 2 and more preferably 1) per silicon atom, and this is thus preferred.

The means for adjusting the Martens hardness through the chemical structure can be, for example, adjustment of the chemical structure, e.g., crosslinking and degree of polymerization, of the surface layer material. The means for adjusting the Martens hardness through the macrostructure can be, for example, adjustment of the shape of the unevenness of the surface layer and adjustment of the network structure that connects between protrusions. When an organosilicon polymer is used for the surface layer, these adjustments can be made through, for example, the pH, concentration, temperature and time during a pretreatment of the organosilicon polymer. In addition, adjustment may also be carried out using the timing, regime, concentration, reaction temperature, and so forth during surface layer attachment of the organosilicon polymer to the toner core particle.

The following method is particularly preferred in the present invention. A core particle dispersion is first obtained by producing toner core particles containing binder resin and colorant and dispersing these toner core particles in an aqueous medium. With regard to the concentration at this point, dispersion is preferably carried out at a concentration that provides a core particle solids fraction of from 10 mass % to 40 mass % with reference to the total amount of the core particle dispersion. The temperature of the core particle dispersion is preferably adjusted to at least 35° C. on a preliminary basis. In addition, the pH of this core particle dispersion is preferably adjusted to a pH that inhibits the occurrence of organosilicon compound condensation. The pH that inhibits the occurrence of organosilicon compound condensation varies with the particular substance, and as a consequence within ±0.5 centered on the pH at which the reaction is most inhibited is preferred.

The organosilicon compound used, on the other hand, has preferably been subjected to a hydrolysis treatment. An example in this regard is a method in which hydrolysis has been carried out on a preliminary basis in a separate vessel as a pretreatment of the organosilicon compound. The charge concentration for the hydrolysis, using 100 mass parts for the amount of the organosilicon compound, is preferably from 40 mass parts to 500 mass parts of water from which the ion fraction has been removed, e.g., deionized water or RO water, and is more preferably from 100 mass parts to 400 mass parts of water. The hydrolysis conditions are preferably as follows: pH of 2 to 7, temperature of 15° C. to 80° C., and time of 30 minutes to 600 minutes.

By mixing the core particle dispersion with the resulting hydrolysis solution and adjusting to a pH suitable for condensation (preferably 6 to 12 or 1 to 3 and more preferably 8 to 12), attachment as a surface layer to the toner core particle surface can be achieved while inducing condensation of the organosilicon compound. Condensation and attachment as a surface layer are preferably executed for at least 60 minutes at at least 35° C. In addition, the macrostructure of the surface can be adjusted by adjusting the holding time at at least 35° C. prior to adjusting to a pH suitable for condensation, and this holding time is preferably from 3 minutes to 120 minutes because this facilitates obtaining the prescribed Martens hardness.

Using the means as described in the preceding, the residual reactive groups can be depleted, unevenness can be formed in the surface layer, and a network structure can be formed between the protrusions, and as a result a toner having the Martens hardness prescribed above can be readily obtained.

When a surface layer containing an organosilicon polymer is used, the fixing ratio for the organosilicon polymer is preferably from 90% to 100%. At least 95% is more preferred. When the fixing ratio is in this range, the Martens hardness undergoes little fluctuation during extended use and charging can be maintained. The method for measuring the fixing ratio for the organosilicon polymer is described below.

Surface Layer

When a toner particle has a surface layer, this surface layer is a layer that coats the toner core particle and is present at the outermost surface of the toner particle. A surface layer containing an organosilicon polymer is much harder than a conventional toner particle. Due to this, from the standpoint of the fixing performance, preferably an area where the surface layer is not formed is also disposed on a portion of the toner particle surface.

However, the percentage for the number of dividing axes having a thickness for the organosilicon polymer-containing surface layer of not more than 2.5 nm (also referred to below as the percentage for a surface layer thickness of not more than 2.5 nm) is preferably not greater than 20.0%. This condition approximates the idea that, over the toner particle surface, at least 80.0% or more is constituted of a greater than 2.5-nm organosilicon polymer-containing surface layer. That is, when this condition is satisfied, the organosilicon polymer-containing surface layer satisfactorily coats the core surface. Not greater than 10.0% is more preferred. The measurement can be carried out by observation of the cross section using a transmission electron microscope (TEM), and the details are described below.

Organosilicon Polymer-Containing Surface Layer

The substructure represented by formula (1) is preferably present when the toner particle has an organosilicon polymer-containing surface layer.

$$R—SiO_{3/2} \qquad \text{formula (1)}$$

(R represents a hydrocarbon group having from 1 to 6 carbons.)

In an organosilicon polymer having the structure with formula (1), of the four valences for the Si atom, one bonds with R and the remaining three bond with oxygen atoms. The O atom has a configuration in which the two valences both bond with Si, that is, it constitutes the siloxane bond (Si—O—Si). Considered as the Si atoms and O atoms in an organosilicon polymer, three O atoms are present for two Si atoms and this is then represented as $—SiO_{3/2}$. It is thought that the $—SiO_{3/2}$ structure of this organosilicon polymer has properties similar to silica ($SiO_2$), which is composed of large numbers of siloxane bonds. Accordingly, it is thought that the Martens hardness can be raised since the structure is closer to an inorganic material than conventional toners in which the surface layer is formed by an organic resin.

Moreover, in the chart obtained by $^{29}$Si-NMR measurement on the tetrahydrofuran (THF)-insoluble matter in the toner particle, the percentage for the peak area assigned to the formula (1) structure with reference to the total peak area for the organosilicon polymer is preferably at least 20%. While the details of the measurement method are provided below, this more or less means that the organosilicon polymer present in the toner particle has at least 20% substructure given by $R—SiO_{3/2}$.

As noted above, of the four valences of the Si atom, three are bonded to oxygen atoms, and the meaning of the $—SiO_{3/2}$ substructure is that these oxygen atoms are bonded to separate Si atoms. When one of these oxygen atoms is made the silanol group, this substructure in the organosilicon polymer is represented by $R—SiO_{2/2}—OH$. When two oxygens are the silanol group, this substructure becomes $R—SiO_{1/2}(—OH)_2$. When these structures are compared, the silica structure given by $SiO_2$ is more nearly approached as more oxygen atoms form crosslink structures with the Si atom. Due to this, the surface free energy of the toner particle surface can be lowered as the $—SiO_{3/2}$ framework becomes more prominent, and as a consequence excellent effects accrue with regard to the environmental stability and the resistance to component contamination.

In addition, bleed out by the bleed out-prone low molecular weight (Mw≤1,000) resins and low Tg (≤40° C.) resins present in the interior from the surface layer, and by the release agent depending on the circumstances, is suppressed due to the durability provided by the formula (1) substructure and due to the charging performance and hydrophobicity of the R in formula (1).

The percentage for the peak area for the formula (1) substructure can be controlled through the type and amount of the organosilicon compound used to form the organosilicon polymer, and through the reaction temperature, reaction time, reaction solvent, and pH in the hydrolysis, addition polymerization, and condensation polymerization during formation of the organosilicon polymer.

The R in the substructure with formula (1) is preferably a hydrocarbon group having from 1 to 6 carbons. This facilitates stability in the amount of charge. Aliphatic hydrocarbon groups having from 1 to 5 carbons and the phenyl group, which exhibit an excellent environmental stability, are particularly preferred.

This R is more preferably an aliphatic hydrocarbon group having from 1 to 3 carbons in the present invention because this provides additional enhancements in the charging performance and fogging prevention. When the charging performance is excellent, the transferability is then excellent and there is little untransferred toner, and as a consequence contamination of the drum, the charging member, and the transfer member is improved.

The methyl group, ethyl group, propyl group, and vinyl group are preferred examples of the aliphatic hydrocarbon group having from 1 to 3 carbons. R is more preferably the methyl group from the standpoint of environmental stability and storage stability.

The sol-gel method is a preferred example of a method for producing the organosilicon polymer. In the sol-gel method, a liquid starting material is used for the starting material, and hydrolysis and condensation polymerization are carried out to induce gelation while passing through a sol state, and this method is used for the synthesis of glasses, ceramics, organic-inorganic hybrids, and nanocomposites. The use of this production method supports the production, from the liquid phase at low temperatures, of functional materials having various shapes, e.g., surface layers, fibers, bulk forms, and fine particles.

In specific terms, the organosilicon polymer present in the surface layer of the toner particle is preferably produced by the hydrolysis and condensation polymerization of a silicon compound as represented by alkoxysilanes.

Through the disposition in the toner particle of a surface layer containing this organosilicon polymer, a toner can be obtained that has an improved environmental stability, is resistant to reductions in toner performance during long-term use, and exhibits an excellent storage stability.

The sol-gel method can produce a variety of fine structures and shapes because it starts from a liquid and forms a material through gelation of this liquid. In particular, when a toner particle is produced in an aqueous medium, precipitation on the toner particle surface is readily brought about by the hydrophilicity due to the hydrophilic groups, such as the silanol group, in the organosilicon compound. The aforementioned fine structure and shape can be adjusted through, for example, the reaction temperature, reaction time, reaction solvent, and pH and the type and amount of the organosilicon compound.

The organosilicon polymer of the surface layer of the toner particle preferably is a condensation polymer from an organosilicon compound having the structure represented by the following formula (Z).

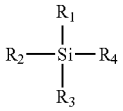

(Z)

(In formula (Z), $R_1$ represents a hydrocarbon group having from 1 to 6 carbons and $R_2$, $R_3$, and $R_4$ each independently represent a halogen atom, hydroxy group, acetoxy group, or alkoxy group.)

The hydrophobicity can be enhanced by the hydrocarbon group $R_1$ (preferably an alkyl group) and a toner particle having an excellent environmental stability can then be obtained. In addition, an aryl group, which is an aromatic hydrocarbon group and is exemplified by the phenyl group, can also be used as the hydrocarbon group. When $R_1$ exhibits a large hydrophobicity, a trend is exhibited of large fluctuations in the amount of charge in different environments, and thus, considering the environmental stability, $R_1$ is preferably an aliphatic hydrocarbon group having from 1 to 3 carbons and is still more preferably the methyl group.

$R_2$, $R_3$, and $R_4$ are each independently a halogen atom, hydroxy group, acetoxy group, or alkoxy group (also referred to in the following as reactive groups). These reactive groups form a crosslinked structure by undergoing hydrolysis, addition polymerization, and condensation polymerization, and a toner can then be obtained that exhibits an excellent resistance to component contamination and an excellent development durability. Alkoxy groups having 1 to 3 carbons are preferred considering their gentle hydrolyzability at room temperature and the ability to precipitate on and coat the toner particle surface, and the methoxy group and ethoxy group are more preferred. The hydrolysis, addition polymerization, and condensation polymerization of $R_2$, $R_3$, and $R_4$ can be controlled through the reaction temperature, reaction time, reaction solvent, and pH. In order to obtain the organosilicon polymer used by the present invention, a single organosilicon compound having three reactive groups ($R_2$, $R_3$, and $R_4$) in the molecule excluding the $R_1$ in formula (Z) (such an organosilicon compound is also referred to below as a trifunctional silane) may be used, or a combination of a plurality of such organosilicon compounds may be used.

Compounds with formula (Z) can be exemplified by the following:

trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

In addition, insofar as the effects of the present invention are not impaired, an organosilicon polymer may be used as obtained using the organosilicon compound having the structure represented by formula (Z) in combination with the following: an organosilicon compound having four reactive groups in the molecule (tetrafunctional silane), an organosilicon compound having two reactive groups in the molecule (difunctional silane), or an organosilicon compound having one reactive group (monofunctional silane). The followings are examples:

dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, and 3-(2-aminoethyl)aminopropyltriethoxysilane and trifunctional vinyl silanes such as vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

The content of the organosilicon polymer in the toner particle is preferably from 0.5 mass % to 10.5 mass %.

By having the organosilicon polymer content be at least 0.5 mass %, the surface free energy of the surface layer can be further reduced and the flowability can then be improved and the occurrence of component contamination and fogging can be suppressed. The occurrence of excessive charging can be inhibited by having the organosilicon polymer content be not more than 10.5 mass %. The organosilicon polymer content can be controlled through the type and amount of the organosilicon compound used to form the organosilicon polymer and through the toner particle production method, the reaction temperature, the reaction time, the reaction solvent, and the pH during formation of the organosilicon polymer.

The toner core particle is preferably in gapless contact with the surface layer containing the organosilicon polymer. As a consequence, the generation of bleed out by, for example, the resin component and release agent, in the interior from the surface layer of the toner particle is restrained and a toner can be obtained that exhibits an excellent storage stability, an excellent environmental stability, and an excellent development durability. Besides the organosilicon polymer as described above, the surface layer may contain, for example, various additives and resins such as styrene-acrylic copolymer resins, polyester resins and urethane resins.

Binder Resin

The toner particle contains a binder resin. There are no particular limitations on this binder resin, and heretofore known binder resins can be used. Preferred examples are vinyl resins and polyester resins. The following resins and polymers are examples of the vinyl resins, polyester resins, and other binder resins:

homopolymers of styrene and its substituted forms such as polystyrene and polyvinyltoluene; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic and alicyclic hydrocarbon resins, and aromatic petroleum resins. A single one of these binder resins may be used by itself or a mixture may be used.

From the standpoint of the charging performance, the binder resin preferably contains the carboxy group and is preferably a resin produced using a carboxy group-containing polymerizable monomer, for example, acrylic acid; derivatives of α-alkyl unsaturated carboxylic acids or derivatives of β-alkyl unsaturated carboxylic acids such as methacrylic acid, α-ethylacrylic acid, and crotonic acid; unsaturated dicarboxylic acids such as fumaric acid, maleic acid, citraconic acid, and itaconic acid; and the unsaturated monoester derivatives of dicarboxylic acids such as monoacryloyloxyethyl succinate, monoacryloyloxyethylene succinate, monoacryloyloxyethyl phthalate, and monomethacryloyloxyethyl phthalate.

The condensation polymers of a carboxylic acid component and alcohol component as exemplified below can be used as the polyester resin. The carboxylic acid component can be exemplified by terephthalic acid, isophthalic acid, phthalic acid, fumaric acid, maleic acid, cyclohexanedicarboxylic acid, and trimellitic acid. The alcohol component can be exemplified by bisphenol A, hydrogenated bisphenol, ethylene oxide adducts on bisphenol A, propylene oxide adducts on bisphenol A, glycerol, trimethylolpropane, and pentaerythritol.

The polyester resin may be a urea group-bearing polyester resin. The carboxyl group in the polyester resin, e.g., in terminal position, is preferably not capped.

The binder resin may have a polymerizable functional group with the goal of improving the viscosity change by the toner upon exposure to high temperatures. This polymerizable functional group is exemplified by the vinyl group, isocyanate group, epoxy group, amino group, carboxy group, and hydroxy group.

Crosslinking Agent

A crosslinking agent may be added to the polymerization of the polymerizable monomer in order to control the molecular weight of the binder resin.

Examples in this regard are ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester-type diacrylates (MANDA, Nippon Kayaku Co., Ltd.), and crosslinking agents provided by converting the acrylates given above to the methacrylates.

The amount of addition for the crosslinking agent is preferably from 0.001 mass parts to 15.000 mass parts per 100 mass parts of the polymerizable monomer.

Release Agent

The toner particle preferably contains a release agent. Release agents useable in the toner particle can be exemplified by petroleum waxes, e.g., paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; fatty acids such as stearic acid and palmitic acid, and acid amide, ester, and ketones thereof; hydrogenated castor oil and derivatives thereof; plant waxes; animal waxes; and silicone resins. The derivatives here include oxides and block copolymers and graft modifications with vinyl monomers.

The release agent content is preferably from 5.0 mass parts to 20.0 mass parts per 100.0 mass parts of the binder resin or polymerizable monomer.

Colorant

The toner particle contains a colorant. There are no particular limitations on the colorant, and, for example, known colorants as indicated below can be used.

Yellow pigments can be exemplified by yellow iron oxide and condensed azo compounds, isoindolinone compounds, anthraquinone compounds, azo metal complexes, methine compounds, and allylamide compounds such as Naples Yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Lake. Specific examples are as follows:

C.I. Pigment Yellow 12, 13, 14, 15, 17, 62, 74, 83, 93, 94, 95, 109, 110, 111, 128, 129, 147, 155, 168, and 180.

Orange pigments can be exemplified by the following:

Permanent Orange GTR, Pyrazolone Orange, Vulcan Orange, Benzidine Orange G, Indanthrene Brilliant Orange RK, and Indanthrene Brilliant Orange GK.

Red pigments can be exemplified by bengara and condensed azo compounds, diketopyrrolopyrrole compounds, anthraquinone compounds, quinacridone compounds, basic dye lake compounds, naphthol compounds, benzimidazolone compounds, thioindigo compounds, and perylene compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, and Alizarin Lake. Specific examples are as follows:

C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Blue pigments can be exemplified by copper phthalocyanine compounds and derivatives thereof, anthraquinone compounds, and basic dye lake compounds such as Alkali Blue Lake, Victoria Blue Lake, Phthalocyanine Blue, metal-free Phthalocyanine Blue, Phthalocyanine Blue partial chloride, Fast Sky Blue, and Indanthrene Blue BG. Specific examples are as follows:

C.I. Pigment Blue 1, 7, 15, 15:1, 15:2, 15:3, 15:4, 60, 62, and 66.

Purple pigments are exemplified by Fast Violet B and Methyl Violet Lake. Green pigments are exemplified by Pigment Green B, Malachite Green Lake, and Final Yellow Green G. White pigments are exemplified by zinc white, titanium oxide, antimony white, and zinc sulfide.

Black pigments are exemplified by carbon black, aniline black, nonmagnetic ferrite, magnetite, and black pigments provided by color mixing using the aforementioned yellow colorants, red colorants, and blue colorants to give a black color. A single one of these colorants may be used by itself, or a mixture of these colorants may be used, and these colorants may be used in a solid solution state.

As necessary, a surface treatment of the colorant may be carried out using a substance that does not inhibit polymerization.

The content of the colorant is preferably from 3.0 mass parts to 15.0 mass parts per 100.0 mass parts of the binder resin or polymerizable monomer.

Charge Control Agent

The toner particle may contain a charge control agent. A known charge control agent may be used as this charge control agent. In particular, a charge control agent is preferred that provides a fast charging speed and that can stably maintain a certain amount of charge. When the toner particle is produced by a direct polymerization method, a charge control agent that has little ability to inhibit polymerization and that substantially lacks material elutable into aqueous media is particularly preferred.

Charge control agents that control the toner particle to negative charging are exemplified by the following:

organometal compounds and chelate compounds such as monoazo metal compounds, acetylacetone/metal compounds, and metal compounds of aromatic oxycarboxylic acids, aromatic dicarboxylic acids, oxycarboxylic acids, and dicarboxylic acid systems. Also otherwise included are aromatic oxycarboxylic acids and aromatic mono- and polycarboxylic acids and their metal salts, anhydrides, and esters; also, phenol derivatives such as bisphenols. Additional examples are urea derivatives, metal-containing salicylic acid compounds, metal-containing naphthoic acid compounds, boron compounds, quaternary ammonium salts, and calixarene.

Charge control agents that control the toner particle to positive charging, on the other hand, are exemplified by the following:

nigrosine and nigrosine modifications such as the fatty acid metal salts; guanidine compounds; imidazole compounds; quaternary ammonium salts such as tributylbenzylammonium-1-hydroxy-4-naphthosulfonate and tetrabutylammonium tetrafluoroborate and onium salts such as phosphonium salts that are their analogs, and their lake pigments; triphenylmethane dyes and their lake pigments (the laking agent is exemplified by phosphotungstic acid, phosphomolybdic acid, phosphotungstomolybdic acid, tannic acid, lauric acid, gallic acid, ferricyanide, and ferrocyanide); the metal salts of higher fatty acids; and resin-type charge control agents.

A single one of these charge control agents can be incorporated or two or more can be incorporated in combination. The amount of addition of the charge control agent is preferably from 0.01 mass parts to 10 mass parts per 100 mass parts of the binder resin.

External Additive

The toner particle may also be regarded as a toner without external addition, but in order to improve, for example, the flowability, charging performance, and cleanability, the toner particle may be made into a toner through the addition of so-called external additives, e.g., a fluidizing agent and cleaning aid.

The external additive can be exemplified by inorganic oxide fine particles such as silica fine particles, alumina fine particles, and titanium oxide fine particles; inorganic/stearic acid compound fine particles such as aluminum stearate fine particles and zinc stearate fine particles; and inorganic titanic acid compound fine particles such as strontium titanate and zinc titanate. A single one of these may be used by itself or a combination of two or more may be used.

In order to enhance the heat-resistant storability and enhance the environmental stability, the inorganic fine particle may be subjected to a surface treatment with, for example, a silane coupling agent, titanium coupling agent, higher fatty acid and silicone oil. The BET specific surface area of the external additive is preferably from 10 $m^2/g$ to 450 $m^2/g$.

The BET specific surface area can be determined according to the BET method (preferably the BET multipoint method) using a cryogenic gas adsorption procedure based on a dynamic constant pressure procedure. For example, using a specific surface area analyzer (product name: Gemini 2375 Ver. 5.0, Shimadzu Corporation), the BET specific surface area ($m^2/g$) can be calculated by measurement carried out using the BET multipoint method and adsorption of nitrogen gas to the sample surface.

With regard to the amount of addition of these various external additives, their sum, per 100 mass parts of the toner particle, is preferably from 0.05 mass parts to 5 mass parts and more preferably from 0.1 mass parts to 3 mass parts. Combinations of the various external additives may be used as the external additive.

The toner preferably has a positively charged particle on the surface of the toner particle. The number-average particle diameter of this positively charged particle is preferably from 0.10 μm to 1.00 μm. From 0.20 μm to 0.80 μm is more preferred.

It was found that when such a positively charged particle is present, an excellent transfer efficiency is obtained during extended use. This is thought to be due to the following: by having this be a positively charged particle with the indicated particle diameter, rolling on the toner particle surface is then made possible, negative charging of the toner by rubbing at between the photosensitive drum and the transfer belt is promoted, and positive biasing due to the application of the transfer bias is effectively suppressed. The toner according to the present invention is characterized by a hard surface, and attachment to or embedding into the toner particle surface by the positively charged particle is thus inhibited and as a consequence a high transfer efficiency can be maintained.

The positively charged particle in the present invention is a particle that assumes a positive charge when triboelectrically charged by mixing and stirring with a standard carrier (anionic: N-01) obtained from The Imaging Society of Japan.

Measurement of the number-average particle diameter of the external additive is performed using an "S-4800" scanning electron microscope (Hitachi, Ltd.). The toner to which the external additive has been externally added is observed, and, in a visual field enlarged a maximum of 200,000×, the long diameter of 100 randomly selected primary particles of the external additive is measured and the number-average particle diameter is calculated. The observation magnification is adjusted as appropriate as a function of the size of the external additive.

Various methods can be contemplated as means for causing the positively charged particles to be present on the toner particle surface, and, while this may be any method, application by external addition is a preferred method. It was discovered that when the Martens hardness of the toner is in the range according to the present invention, the positively charged particles can be uniformly disposed on the toner particle surface. The fixing ratio for the positively charged particles to the toner particle is preferably from 5% to 75% and is more preferably from 5% to 50%. When the fixing ratio is in this range, a high transfer efficiency can then be maintained due to the promotion of triboelectric charging of the toner particle and positively charged particle. The method for measuring the fixing ratio is described below.

The type of positively charged particle is preferably a hydrotalcite, titanium oxide, melamine resin, and so forth. Hydrotalcite is particularly preferred among the preceding.

The presence of boron nitride on the toner particle surface is also preferred. The means for causing the boron nitride to be present on the toner particle surface is not particularly limited, but application by external addition is a preferred method. It was discovered that, when the Martens hardness of the toner is in the range according to the present invention, the boron nitride can be uniformly disposed on the toner particle surface at high fixing ratio and there is little reduction in the fixing ratio during extended use.

Boron nitride is a material that exhibits cleavage. It was shown that, with a toner in the hardness range of the present invention, the external addition process results in the boron nitride undergoing film formation on the toner particle surface at the same time that it undergoes cleavage. The presence of the boron nitride makes it possible to suppress melt adhesion by the toner to developing members, and particularly the developing roller, during extended use. This has made it possible to maintain the amount of charge on the toner during extended use even for a replenishing system.

Boron nitride is also a material with a high thermal conductivity. It is therefore presumed that the heat generated by rubbing with members during development readily escapes and the effect then accrues of a suppression of heat-induced outmigration of toner particle materials. The fixing ratio for the boron nitride to the toner particle is preferably from 80% to 100% and is more preferably from 85% to 98%. Melt adhesion to the developing roller can be more effectively suppressed when the fixing ratio is in this range.

Developer

The toner according to the present invention may be used as a magnetic or nonmagnetic single-component developer, but may also be used mixed with a carrier as a two-component developer.

Magnetic particles comprising a known material, for example, a metal such as iron, ferrite, or magnetite, or an alloy of these metals with a metal such as aluminum or lead, can be used as the carrier. Among these, the use of ferrite particles is preferred. In addition, a coated carrier as provided by coating the surface of a magnetic particle with a coating agent such as a resin, or a resin-dispersed carrier as provided by the dispersion of magnetic fine particles in a binder resin, may be used as the carrier.

The volume-average particle diameter of the carrier is preferably from 15 μm to 100 μm and is more preferably from 25 μm to 80 μm.

Toner Particle Production Methods

Known means can be used for the method of producing the toner particle, and a kneading/pulverization method or a wet production method may be used. The use of a wet production method is preferred from the standpoint of the ability to control the shape and provide a uniform particle diameter. Wet production methods can be exemplified by the suspension polymerization method, dissolution suspension method, emulsion polymerization and aggregation method, and emulsion aggregation method.

The suspension polymerization method is described here. In the suspension polymerization method, the polymerizable monomer for producing the binder resin, the colorant, and other optional additives are first dissolved or dispersed to uniformity using a disperser such as a ball mill or ultrasound disperser to prepare a polymerizable monomer composition (step of preparing a polymerizable monomer composition). At this point, the following, for example, may optionally be added as appropriate: multifunctional monomer, chain transfer agent, wax functioning as a release agent, charge control agent, and plasticizer. The following polymerizable vinyl monomers are preferred examples of the polymerizable monomer in the suspension polymerization method:

styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; esters of methylene aliphatic monocarboxylic acids; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

This polymerizable monomer composition is then introduced into a preliminarily prepared aqueous medium and droplets of the polymerizable monomer composition are formed, so as to provide the desired toner particle size, using a disperser or stirrer that generates a high shear force (granulation step).

The aqueous medium in the granulation step preferably contains a dispersion stabilizer in order to control the particle diameter of the toner particle, sharpen its particle size distribution, and suppress agglomeration of the toner particles during the production process. Dispersion stabilizers may be broadly classified into polymers, which generally develop a repulsive force through steric hindrance, and sparingly water-soluble inorganic compounds, which support dispersion stabilization through an electrostatic repulsive force. Fine particles of a sparingly water-soluble inorganic compound, because they are dissolved by acid or alkali, are preferably used because they can be easily removed after polymerization by dissolution by washing with acid or alkali.

A dispersion stabilizer containing magnesium, calcium, barium, zinc, aluminum, or phosphorus is preferably used for the sparingly water-soluble inorganic compound dispersion stabilizer. This dispersion stabilizer more preferably contains magnesium, calcium, aluminum, or phosphorus. Specific examples are as follows:

magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite. An organic compound, for example, polyvinyl alcohol, gelatin, methyl cellulose, methylhydroxypropyl cellulose, ethyl cellulose, the sodium salt of carboxymethyl cellulose, or starch, may be co-used in this dispersion stabilizer. The dispersion stabilizer is preferably used at from 0.01 mass parts to 2.00 mass parts per 100 mass parts of the polymerizable monomer.

In order to microfine-size the dispersion stabilizer, from 0.001 mass parts to 0.1 mass parts of a surfactant may be co-used per 100 mass parts of the polymerizable monomer. In specific terms, a commercial nonionic, anionic, or cationic surfactant can be used. Examples are sodium dodecyl sulfate, sodium tetradecyl sulfate, sodium pentadecyl sulfate, sodium octyl sulfate, sodium oleate, sodium laurate, potassium stearate, and calcium oleate.

Either after the granulation step or while the granulation step is being carried out, preferably the temperature is set to from 50° C. to 90° C. and the polymerizable monomer present in the polymerizable monomer composition is polymerized to obtain a toner particle dispersion (polymerization step).

A stirring operation may be carried out during the polymerization step so as to provide a uniform temperature distribution within the vessel. When a polymerization initiator is added, this can be carried out using any timing and at the required time. In addition, the temperature may be increased in the latter half of the polymerization reaction with the goal of obtaining a desired molecular weight distribution. In order to remove, e.g., unreacted polymerizable monomer and by-products, from the system, a portion of the aqueous medium may be distilled off by a distillation process either in the latter half of the reaction or after the completion of the reaction. The distillation process may be carried out at normal pressure or under reduced pressure.

An oil-soluble initiator is generally used as the polymerization initiator that is used in the suspension polymerization method, and examples are as follows:

azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide-type initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A water-soluble initiator may be co-used as necessary for the polymerization initiator, and examples are as follows: ammonium persulfate, potassium persulfate, 2,2'-azobis(N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrilesulfonate, ferrous sulfate, and hydrogen peroxide.

A single one of these polymerization initiators may be used or combinations of these polymerization initiators may be used, and, for example, a chain transfer agent and polymerization inhibitor may also be added and used in order to control the degree of polymerization of the polymerizable monomer.

The weight-average particle diameter of the toner particle is preferably from 3.0 μm to 10.0 μm from the standpoint of obtaining a high-definition and high-resolution image. The weight-average particle diameter of the toner can be measured using the pore electrical resistance method. For example, the measurement can be performed using a "Coulter Counter Multisizer 3" (Beckman Coulter, Inc.). The obtained toner particle dispersion is forwarded to a filtration step in which the toner particle and aqueous medium are subjected to solid-liquid separation.

This solid-liquid separation for recovering the toner particle from the obtained toner particle dispersion can be performed using a common filtration procedure. This is preferably followed by additional washing using reslurrying and a water wash in order to remove foreign material that could not be completely removed from the toner particle surface. After a thorough washing has been performed, another solid-liquid separation then yields a toner cake. After this, drying may be performed by known drying means and as necessary particle populations having particle diameters other than the specified particle diameter may be separated by classification to obtain a toner particle. When this is performed, the separated particle populations having out-of-specification particle diameters may be re-used in order to improve the final yield.

When a surface layer having an organosilicon polymer is to be formed, and considering the case of toner particle formation in an aqueous medium, this surface layer can be formed by adding the previously described hydrolysis solution of an organosilicon compound during, for example, the polymerization step in the aqueous medium. After the polymerization, the toner particle dispersion may be used as a core particle dispersion and the surface layer may be formed by the addition of the organosilicon compound hydrolysis solution. In addition, a toner particle obtained without using an aqueous medium, for example, as in the kneading/pulverization method, may be dispersed in an aqueous medium to provide a core particle dispersion, and the surface layer may be formed by the addition of the aforementioned organosilicon compound hydrolysis solution to this core particle dispersion.

Methods for Measuring Toner Properties

Procedure for Isolating the THF-Insoluble Matter of the Toner Particle for NMR Measurement The tetrahydrofuran (THF)-insoluble matter in the toner particle can be obtained proceeding as follows.

10.0 g of the toner particle is weighed out and is introduced into an extraction thimble (No. 86R, Toyo Roshi Kaisha, Ltd.), and this is placed in a Soxhlet extractor. Extraction is performed for 20 hours using 200 mL of tetrahydrofuran as the solvent, and the residue in the extraction thimble is vacuum dried for several hours at 40° C. to obtain the THF-insoluble matter of the toner particle for NMR measurement.

When the toner particle surface has been treated with, for example, an external additive, the toner particle is obtained by removal of this external additive using the following procedure.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume) to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL volume) for swing rotor service, and separation is performed in a centrifugal separator (H-9R, Kokusan Co., Ltd.) using conditions of 3,500 rpm and 30 minutes. The toner particle is separated from the detached external additive by this process. Satisfactory separation of the toner from the aqueous solution is checked visually, and the toner separated into the uppermost layer is recovered with, for example, a spatula. The recovered toner is filtered on a vacuum filter and then dried for at least 1 hour in a drier to yield the toner particle. This process is carried out a plurality of times to secure the required amount.

Method for Confirming the Substructure Represented by Formula (1)

The following method is used to confirm the substructure represented by formula (1) in the organosilicon polymer contained in the toner particle.

The hydrocarbon group represented by R in formula (1) is confirmed by $^{13}$C-NMR.

Measurement Conditions in $^{13}$C-NMR (Solid State)
Instrument: JNM-ECX500II, Jeol Resonance Inc.
Sample tube: 3.2 mmØ
Sample: tetrahydrofuran-insoluble matter of the toner particle for NMR
measurement, 150 mg
Measurement temperature: room temperature
Pulse mode: CP/MAS
Measurement nucleus frequency: 123.25 MHz ($^{13}$C)
Reference substance: adamantane (external reference: 29.5 ppm)
Sample spinning rate: 20 kHz
Contact time: 2 ms
Delay time: 2 s
Number of accumulations: 1,024

The hydrocarbon group represented by R in formula (1) is confirmed by this method through the presence/absence of a signal originating with, for example, a silicon atom-bonded methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6H_{13}$), or phenyl group (Si—$C_6H_5$).

Method for Calculating the Percentage of the Peak Area Assigned to the Formula (1) Structure for the Organosilicon Polymer Contained in the Toner Particle $^{29}$Si-NMR (solid state) measurement on the tetrahydrofuran-insoluble matter in the toner particle is carried out using the following measurement conditions.

Measurement Conditions in $^{29}$Si-NMR (Solid State)
Instrument: JNM-ECX500II, Jeol Resonance Inc.
Sample tube: 3.2 mmØ
Sample: tetrahydrofuran-insoluble matter of the toner particle for NMR
measurement, 150 mg
Measurement temperature: room temperature
Pulse mode: CP/MAS
Measurement nucleus frequency: 97.38 MHz ($^{29}$Si)
Reference substance: DSS (external reference: 1.534 ppm)
Sample spinning rate: 10 kHz
Contact time: 10 ms
Delay time: 2 s
Number of accumulations: 2,000 to 8,000

After this measurement, peak separation is performed into the following structure X1, structure X2, structure X3, and structure X4 by curve fitting for a plurality of silane components having different substituents and bonding groups, for the tetrahydrofuran-insoluble matter of the toner particle, and their respective peak areas are calculated.

Structure X1: $(Ri)(Rj)(Rk)SiO_{1/2}$ formula (2)

Structure X2: $(Rg)(Rh)Si(O_{1/2})_2$ formula (3)

Structure X3: $RmSi(O_{1/2})_3$ formula (4)

Structure X4: $Si(O_{1/2})_4$ formula (5)

Structure X1:

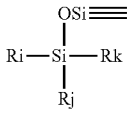

(2)

Structure X2:

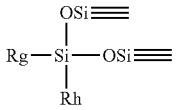

(3)

Structure X3:

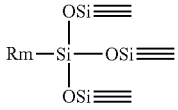

(4)

Structure X4:

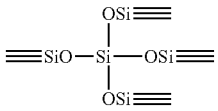

(5)

(The Ri, Rj, Rk, Rg, Rh, and Rm in formulas (2), (3), and (4) represent silicon atom-bonded organic groups, e.g., hydrocarbon groups having from 1 to 6 carbons, a halogen atom, hydroxy group, acetoxy group, or alkoxy group.)

In the chart obtained by $^{29}$Si-NMR measurement on the THF-insoluble matter in the toner particle, the percentage for the peak area assigned to the formula (1) structure with reference to the total peak area for the organosilicon polymer is preferably at least 20% in the present invention.

When a more discriminating determination of the substructure represented by formula (1) is required, identification can be carried out using the measurement results from $^{1}$H-NMR in combination with these measurement results from $^{13}$C-NMR and $^{29}$Si-NMR.

Method for Measuring the Percentage For an Organosilicon Polymer-Containing Surface Layer Thickness of Not More Than 2.5 nm, as Measured by Observation of the Toner Particle Cross Section Using a Transmission Electron Microscope (TEM)

Observation of the toner particle cross section is performed for the present invention using the following method.

In the specific method for observing the toner particle cross section, the toner particles are thoroughly dispersed in a normal temperature-curable epoxy resin and curing is carried out for 2 days in a 40° C. atmosphere. Thin samples are sliced from the resulting cured material using a microtome equipped with diamond blade. The toner particle cross section is observed by enlarging the sample to 10,000× to 100,000× using a transmission electron microscope (TEM) (JEM-2800, Jeol Resonance Inc.).

The confirmation can be performed utilizing the difference in the atomic weights between the binder resin and surface layer material and utilizing the fact that a clear contrast occurs for large atomic weights. A ruthenium tetroxide stain and an osmium tetroxide stain are used to enhance the contrast between materials.

The circle-equivalent diameter Dtem is determined for the toner particle cross section obtained from the TEM micrograph, and the particles used for the measurement are those particles for which this value falls within the range of ±10% of the weight-average toner particle diameter D4 as determined by the method described below.

Using the JEM-2800 from Jeol Resonance Inc. as indicated above, the dark field image of the toner particle cross section is acquired at an acceleration voltage of 200 kV. Then, using a GIF Quantum EELS detector from Gatan, Inc., the mapping image is acquired by the three window method and the surface layer is identified.

On the single toner particle having a circle-equivalent diameter Dtem within the range of ±10% of the weight-average toner particle diameter D4, the toner particle cross section is evenly divided into sixteenths (refer to FIG. 1) using, as the center, the intersection between the long axis L of the toner particle cross section and the axis L90 that is perpendicular to the axis L through its center. Each of the dividing axes that run from this center to the toner particle surface layer is labeled An (n=1 to 32); RAn is used for the dividing axis length; and FRAn is used for the thickness of the surface layer.

The percentage is determined for the number of dividing axis, of these 32 dividing axes, for which the thickness of the organosilicon polymer-containing surface layer on the individual dividing axis is not more than 2.5 nm. For averaging, the measurements are carried out on 10 toner particles and the average value per one toner particle is calculated.

Circle-Equivalent Diameter (Dtem) Determined from the Toner Particle Cross Section Obtained from the Transmission Electron Microscope (TEM) Photograph The following method is used to determine the circle-equivalent diameter (Dtem) determined from the toner particle cross section obtained from the TEM photograph. For a single toner particle, the circle-equivalent diameter Dtem determined from the toner particle cross section obtained from the TEM photograph is first determined using the following formula. [Circle-equivalent diameter (Dtem) determined from the toner particle cross section obtained from the TEM photograph]=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16

The circle-equivalent diameter is determined for 10 toner particles, and the average value per one particle is calculated and used as the circle-equivalent diameter (Dtem) determined from the toner particle cross section.

Percentage for an Organosilicon Polymer-Containing Surface Layer Thickness of Not More Than 2.5 nm

[Percentage for which the organosilicon polymer-containing surface layer thickness (FRAn) is not more than 2.5 nm]=[{number of dividing axes for which the organosilicon polymer-containing surface layer thickness (FRAn) is not more than 2.5 nm}/32]×100

This calculation is performed for 10 toner particles, and the average value of the resulting 10 values of the percentage for which the surface layer thickness (FRAn) is not more than 2.5 nm is determined and is used as the percentage for which the surface layer thickness (FRAn) of the toner particle is not more than 2.5 nm.

Measurement of the Particle Diameter of the Toner Particle

A precision particle size distribution measurement instrument operating on the pore electrical resistance method (product name: Coulter Counter Multisizer 3) and its dedicated software (product name: Beckman Coulter Multisizer 3 Version 3.51, Beckman Coulter, Inc.) are used. A 100 μm aperture diameter is used; the measurements are carried out in 25,000 channels for the number of effective measurement channels; and the measurement data is analyzed and the calculations are performed. The aqueous electrolyte solution used for the measurements is prepared by dissolving special-grade sodium chloride in deionized water to provide a concentration of approximately 1 mass %, and, for example, ISOTON II (product name) from Beckman Coulter, Inc. can be used. The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using (standard particle 10.0 μm, Beckman Coulter, Inc.). The threshold value and noise level are automatically set by pressing the threshold value/noise level measurement button. In addition, the current is set to 1,600 μA; the gain is set to 2; the electrolyte is set to ISOTON II (product name); and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the aforementioned aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the aforementioned aqueous electrolyte solution is introduced into a 100-mL flat-bottom glass beaker. To this is added approximately 0.3 mL of a dilution prepared by the three-fold (mass) dilution with deionized water of Contaminon N (product name) (a 10 mass % aqueous solution of a neutral detergent for cleaning precision measurement instrumentation, Wako Pure Chemical Industries, Ltd.).

(3) A prescribed amount of deionized water and approximately 2 mL of Contaminon N (product name) are added to the water tank of an ultrasound disperser having an electrical output of 120 W and equipped with two oscillators (oscillation frequency=50 kHz) disposed such that the phases are displaced by 180° (product name: Ultrasonic Dispersion System Tetora 150, Nikkaki Bios Co., Ltd.).

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner (particles) is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the aqueous electrolyte solution prepared in (5), in which the toner (particles) is dispersed, is dripped into the round-bottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the "analysis/numerical statistical value (arithmetic average)" screen is the number-average particle diameter (D1).

Measurement of the Content of the Organosilicon Polymer in the Toner Particle

The content of the organosilicon polymer is measured using an "Axios" wavelength-dispersive x-ray fluorescence analyzer (Malvem Panalytical B.V.) and the "SuperQ ver. 4.0F" (Malvem Panalytical B.V.) software provided with the instrument in order to set the measurement conditions and analyze the measurement data. Rh is used for the x-ray tube anode; a vacuum is used for the measurement atmosphere; the measurement diameter (collimator mask diameter) is 27 mm; and the measurement time is 10 seconds. Detection is carried out with a proportional counter (PC) in the case of measurement of the light elements, and with a scintillation counter (SC) in the case of measurement of the heavy elements.

4 g of the toner particle is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

0.5 mass parts of silica ($SiO_2$) fine powder is added to 100 mass parts of the toner particle lacking the organosilicon polymer, and thorough mixing is performed using a coffee mill. 5.0 mass parts and 10.0 mass parts of the silica fine powder are each likewise mixed with 100 mass parts of the toner particle, and these are used as samples for construction of a calibration curve.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis. The toner particle to be analyzed is then made into a pellet proceeding as above using the tablet compression molder and is subjected to measurement of its Si-Kα radiation count rate. The content of the organosilicon polymer in the toner particle is determined from the aforementioned calibration curve.

Method for Measuring the Fixing Ratio for the Organosilicon Polymer

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume) to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL volume) for swing rotor service, and separation is performed with a centrifugal separator (H-9R, Kokusan Co., Ltd.) using conditions of 3,500 rpm and 30 minutes. Satisfactory separation of the toner from the aqueous solution is checked visually, and the toner separated into the uppermost layer is recovered with, for example, a spatula. The aqueous solution containing the recovered toner is filtered on a vacuum filter and then dried for at least 1 hour in a drier. The dried product is crushed with a spatula and the amount of silicon is measured by x-ray fluorescence. The fixing ratio (%) is calculated from the ratio for the amount of the measured element between the post-water-wash toner and the starting toner (unwashed toner).

Measurement of the x-ray fluorescence of the particular element is based on JIS K 0119-1969 and is specifically as follows.

An "Axios" wavelength-dispersive x-ray fluorescence analyzer (Malvern Panalytical B.V.) is used as the measurement instrumentation, and the "SuperQ ver. 4.0F" (Malvern Panalytical B.V.) software provided with the instrument is used in order to set the measurement conditions and analyze the measurement data. Rh is used for the x-ray tube anode; a vacuum is used for the measurement atmosphere; the measurement diameter (collimator mask diameter) is 10 mm; and the measurement time is 10 seconds. Detection is carried out with a proportional counter (PC) in the case of measurement of the light elements, and with a scintillation counter (SC) in the case of measurement of the heavy elements.

Approximately 1 g of the post-water-wash toner or starting toner is introduced into a specialized aluminum compaction ring having a diameter of 10 mm and is smoothed over, and, using a "BRE-32" tablet compression molder (Maekawa Testing Machine Mfg. Co., Ltd.), a pellet is produced by molding to a thickness of approximately 2 mm by compressing for 60 seconds at 20 MPa, and this pellet is used as the measurement sample.

The measurement is carried out using these conditions and element identification is performed based on the obtained x-ray peak positions, and their concentration is calculated from the count rate (unit: cps), which is the number of x-ray photons per unit time.

To quantitate, for example, the amount of silicon in the toner, for example, 0.5 mass parts of silica ($SiO_2$) fine powder is added to 100 mass parts of the toner particle and thorough mixing is performed using a coffee mill. 2.0 mass parts and 5.0 mass parts of the silica fine powder are each likewise mixed with the toner particle, and these are used as samples for calibration curve construction.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis. The toner to be analyzed is then made into a pellet proceeding as above using the tablet compression molder and is subjected to measurement of its Si-Kα radiation count rate. The content of the organosilicon polymer in the toner is determined from the aforementioned calibration curve. The ratio of the amount of the element in the post-water-wash toner to the amount of the element in the starting toner calculated by this method is determined and is used as the fixing ratio (%).

Method for Measuring the Fixing Ratio for the Positively Charged Particle

An element present in the positively charged particle is used as the element to be measured in the Method for Measuring the Fixing Ratio for the Organosilicon Polymer. For example, in the case of hydrotalcite, magnesium and aluminum can be used for the measurement target. Other than this, the fixing ratio for the positively charged particle is measured by the same method.

Method for Measuring the Fixing Ratio for the Boron Nitride

Boron is used for the element to be measured in the Method for Measuring the Fixing Ratio for the Organosilicon Polymer. Other than this, the fixing ratio for boron nitride is measured by the same method. The boron nitride fixing ratio is also measured by the same method after toner replenishment and the output of 4,000 prints.

EXAMPLES

The present invention is specifically described in the following using examples, but the present invention is not limited to or by these examples. Unless specifically indicated otherwise, "parts" and "%" for the materials in the examples and comparative examples are on a mass basis in all instances.

Example 1

Aqueous Medium 1 Preparation Step 14.0 parts of sodium phosphate (dodecahydrate) (RASA Industries, Ltd.) was introduced into 1,000.0 parts of deionized water in a reaction vessel, and the temperature was maintained for 1.0 hour at 65° C. while purging with nitrogen.

While stirring at 12,000 rpm using a T.K. Homomixer (Tokushu Kika Kogyo Co., Ltd.), an aqueous calcium chloride solution of 9.2 parts of calcium chloride (dihydrate) dissolved in 10.0 parts of deionized water was added all at once to prepare an aqueous medium containing a dispersion stabilizer. 10 mass % hydrochloric acid was introduced into the aqueous medium to adjust the pH to 5.0, thereby yielding aqueous medium 1.

Step of Hydrolyzing the Organosilicon Compound for the Surface Layer 60.0 parts of deionized water was metered into a reaction vessel equipped with a stirrer and thermometer and the pH was adjusted to 3.0 using 10 mass % hydrochloric acid. The temperature of this was brought to 70° C. by heating while stirring. This was followed by the addition of 40.0 parts of methyltriethoxysilane, which was the organosilicon compound for the surface layer, and stirring for 2 hours to carry out hydrolysis. The end point for the hydrolysis was confirmed visually when oil-water separation was absent and a single layer was assumed; cooling then yielded a hydrolysis solution of the organosilicon compound for the surface layer.

Polymerizable Monomer Composition Preparation Step

Styrene: 60.0 parts

C.I. Pigment Blue 15:3: 6.5 parts

These materials were introduced into an attritor (Mitsui Miike Chemical Engineering Machinery Co., Ltd.), and a pigment dispersion was prepared by dispersing for 5.0 hours at 220 rpm using zirconia particles having a diameter of 1.7 mm. The following materials were added to this pigment dispersion.

Styrene: 20.0 parts

N-butyl acrylate: 20.0 parts

Crosslinking agent (divinylbenzene): 0.3 parts

Saturated polyester resin: 5.0 parts (polycondensate (molar ratio=10:12) of propylene oxide-modified bisphenol A (2 mol adduct) and terephthalic acid, glass transition temperature Tg=68° C., weight-average molecular weight Mw=10,000, molecular weight distribution Mw/Mn=5.12)

Fischer-Tropsch wax (melting point=78° C.): 7.0 parts

This was held at 65° C. and dissolution and dispersion to homogeneity were carried out at 500 rpm using a T.K. Homomixer (Tokushu Kika Kogyo Co., Ltd.) to prepare a polymerizable monomer composition.

Granulation Step

While holding the temperature of the aqueous medium 1 at 70° C. and holding the rotation speed of the T.K. Homomixer at 12,000 rpm, the polymerizable monomer composition was introduced into the aqueous medium 1 and 9.0 parts of the polymerization initiator t-butyl peroxypivalate was added. This was granulated in this state for 10 minutes while maintaining the stirring device at 12,000 rpm.

Polymerization Step

After the granulation step, the stirrer was changed over to a propeller stirring blade, and a polymerization was run for 5.0 hours while maintaining 70° C. while stirring at 150 rpm. A polymerization reaction was then run by raising the temperature to 85° C. and heating for 2.0 hours, to obtain core particles. The temperature of the slurry was cooled to 55° C., and measurement of the pH gave pH=5.0. While continuing to stir at 55° C., 20.0 parts of the hydrolysis solution of the organosilicon compound for the surface layer was added to start formation of the surface layer on the toner. The surface layer was formed by holding in this state for 30 minutes; adjusting the pH of the slurry, using an aqueous sodium hydroxide solution, to 9.0 to complete the condensation; and holding for an additional 300 minutes.

Washing and Drying Step

After the completion of the polymerization step, the obtained toner particle slurry was cooled; hydrochloric acid was added to the toner particle slurry to adjust the pH to 1.5 or below; holding was carried out for 1 hour while stirring; and solid-liquid separation was thereafter performed using a pressure filter to obtain a toner cake. This was reslurried with deionized water to provide another dispersion, after which solid-liquid separation was performed with the aforementioned filter. Reslurrying and solid-liquid separation were repeated until the electrical conductivity of the filtrate reached 5.0 μS/cm or less, and a toner cake was obtained by the final solid-liquid separation.

The obtained toner cake was dried using a Flash Jet Dryer air current dryer (Seishin Enterprise Co., Ltd.), and the fines and coarse powder were cut using a Coanda effect-based multi-grade classifier to obtain toner particle 1. The drying conditions were an injection temperature of 90° C. and a dryer outlet temperature of 40° C., and the toner cake feed rate was adjusted in conformity to the moisture content of the toner cake to a rate at which the outlet temperature did not deviate from 40° C.

Silicon mapping was performed on the cross section of toner particle 1 during TEM observation, and the presence of the silicon atom in the surface layer was confirmed; it was also confirmed that the percentage for the number of dividing axes having a thickness for the organosilicon polymer-containing toner particle surface layer of not more than 2.5 nm was not greater than 20.0%. With regard to the organosilicon polymer-containing surface layer, it was also confirmed in the following examples, by the same silicon mapping, that the silicon atom was present in the surface layer and that the percentage for the number of dividing axes having a surface layer thickness of not more than 2.5 nm was not greater than 20.0%. In the present example, the obtained toner particle 1 was used as such without external addition as toner 1.

The methods used in the evaluations carried out on toner 1 are described in the following.

Measurement of the Martens Hardness

The measurement was performed by the method described in the Description of the Embodiments.

Method for Measuring the Fixing Ratio

The measurement was performed by the method described in Methods for Measuring Toner Properties.

Print Out Evaluation

A modified commercial LBP7600C laser beam printer from Canon, Inc. was used. The modification comprised altering the main unit of the evaluation machine and its software to set the rotation speed of the developing roller to rotate at a peripheral velocity that was 1.8-times greater. Specifically, the rotation speed of the developing roller prior to modification was a peripheral velocity of 200 mm/sec, and its rotation speed after modification was 360 mm/sec.

40 g of the toner was filled into a toner cartridge for the LBP7600C. This toner cartridge was held for 24 hours in a normal-temperature, normal-humidity environment (25° C./50% RH, NN). After holding for 24 hours in this environment, the cartridge was installed in the LBP7600C.

For the evaluations of the charge rise, D roller Si amount, transferability, and retransferability, the evaluations were performed after 4,000 prints of an image with a print percentage of 35.0% had been printed out in the A4 paper width direction in the NN environment. An initial evaluation of the charge rise was also performed.

In addition, after the evaluation series had been completed, the toner cartridge was replenished with 40 g of toner that had been held for 24 hours in the normal-temperature, normal-humidity environment (25° C./50% RH, NN), and the toner cartridge was installed in the modified LBP7600C. 4,000 prints of an image with a print percentage of 1.0% were then made in the A4 paper width direction in the NN environment, and the "4,000 prints post-replenishment" evaluations were performed. The charge rise, transferability, and retransferability were evaluated.

Evaluation of Development Streaks

A halftone image (toner laid-on level: 0.2 mg/cm$^2$) was printed out on letter-size XEROX 4200 paper (Xerox Corporation, 75 g/m$^2$), and an evaluation of the development streaks was performed. C or better was regarded as satisfactory.

A: Vertical streaks in the paper discharge direction are not seen on the developing roller or on the image.

B: Not more than 5 fine streaks in the circumferential direction at the two ends of the developing roller are seen. Or, vertical streaks in the paper discharge direction are seen on the image to a minor degree.

C: From 6 to 20 fine streaks in the circumferential direction at the two ends of the developing roller are seen. Or, not more than 5 fine streaks are seen on the image.

D: 21 or more streaks are seen on the developing roller. Or, 1 or more significant streaks or 6 or more fine streaks are seen on the image.

Ghost Evaluation 10 prints were continuously made of an image constructed by the repetition of a 3 cm-wide solid vertical line and solid white vertical line; one print of a halftone image was then made; and the pre-image history remaining on the image was visually inspected. By carrying out a reflection density measurement using a MacBeth densitometer (MacBeth Corporation) with an SPI filter, the image density of the halftone image was adjusted to provide a reflection density of 0.4.

A: Ghosts are not produced.

B: A slight pre-image history could be visually confirmed in some areas.

C: A pre-image history could be visually confirmed in some areas.

D: A pre-image history could be visually confirmed in all areas.

Evaluation of the Cleaning Performance

Five prints of a halftone image having a toner laid-on level of 0.2 mg/cm$^2$ were made and evaluated.

A: There are no images with faulty cleaning, and the charging roller is also not dirty.

B: There are no images with faulty cleaning, and the charging roller is dirty.

C: Faulty cleaning could be identified to a minor degree on the halftone image.

D: Faulty cleaning is conspicuous on the halftone image.

Figure 2:
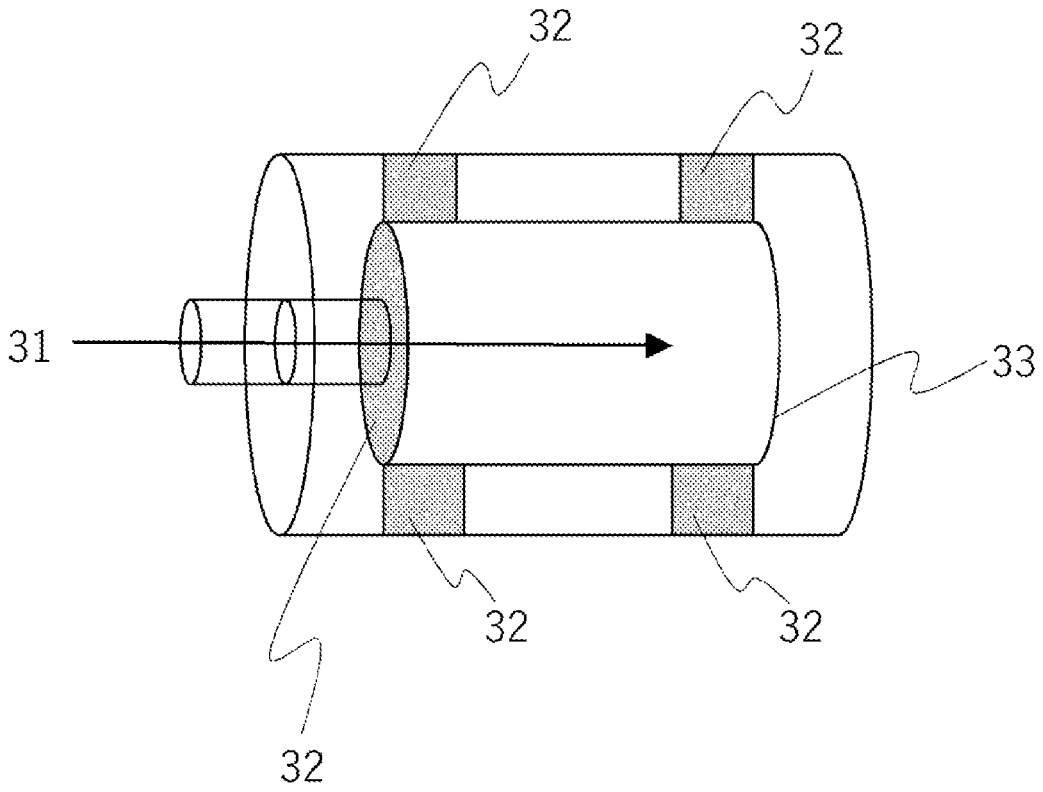
FIG. 2 is an example of a Faraday cage.

Evaluation of Charge Rise 10 prints of a solid image are output. The machine is forcibly halted during the output of the 10th print, and the amount of toner charge on the developing roller immediately after passage past the regulating blade is measured. The amount of charge on the developing roller was measured using the Faraday cage shown in the perspective diagram in FIG. 2. The toner on the developing roller was suctioned in by placing the interior (right side in the figure) under reduced pressure, and the toner was collected by the disposition of a toner filter 33. 31 refers to the suction zone, and 32 refers to a holder. Using the mass M of the collected toner and the charge Q directly measured with a Coulombmeter, the amount of charge per unit mass Q/M (μC/g) was calculated and was taken to be the amount of toner charge (Q/M), and this was rank scored as follows.

A: less than −40 μC/g

B: equal to or greater than −40 μC/g and less than −30 μC/g

C: equal to or greater than −30 μC/g and less than −20 μC/g

D: equal to or greater than −20 μC/g

Method for Measuring the Developing (D) Roller Si Amount

After the 4,000 prints had been made as described above, the developing roller is removed from the cartridge used and the toner is removed using a blower. The surface of the developing roller in the area 10 cm in the longitudinal direction is sliced with a cutter to provide an area of 5 mm×5 mm and a thickness of 1 mm and is fixed with carbon tape to a sample stand. The sample-bearing sample stand is placed in the sample chamber of a Pt ion sputter coater (E-1045, Hitachi, Ltd.), and Pt vapor deposition is performed at a vacuum of 7.0 Pa with the discharge current set to 15 mA, the discharge time set to 20 seconds, and the distance from the Pt target to the sample surface set to 3 cm. The obtained sample is observed with a transmission electron microscope (JSM-7800, Jeol Resonance Inc.). The observation conditions are as follows.

Observation mode: SEM

Detector: LED

Filter: 3

Irradiation current: 8

WD: 10.0 mm

Acceleration voltage: 5 kV

The field of observation is adjusted to 500× and EDS analysis (NORAN System 7, Thermo Fisher Scientific Inc.) is carried out. The conditions are set as indicated below; carbon, oxygen, silicon, and platinum are selected by setting the elements; and the electron beam image of the entire visual field is collected.

EDS

Lifetime limit: 30 seconds

Time constant: Rate1

Quantitation of the spectrum is then performed and the percentages (atm %) for each element, i.e., carbon, oxygen, silicon, and platinum, are determined. The value provided by dividing the obtained silicon percentage (atm %) by the platinum percentage (atm %) is designated the developing roller Si amount for the particular visual field. This developing roller Si amount was measured in three visual fields, and the average value of these was designated the final developing roller Si amount (atm %) and was evaluated using the following criteria.

A: less than 1.00

B: at least 1.00 and less than 3.00

C: at least 3.00 and less than 5.00

D: at least 5.00

Evaluation of the Transferability

The transferability (untransferred density) was evaluated. A solid image was output, and the untransferred toner on the photosensitive member during formation of the solid image was taped and stripped off using a transparent polyester pressure-sensitive adhesive tape. The density difference was calculated by subtracting the density of only the pressure-sensitive adhesive tape pasted on paper from the density of the stripped-off pressure-sensitive adhesive tape pasted on the paper. An evaluation as indicated below was performed using the value of this density difference. The density was measured using an X-Rite color reflection densitometer (X-Rite 500 Series, X-Rite Inc.).

Evaluation Criteria

A: the density difference is less than 0.05

B: the density difference is at least 0.05 and less than 0.10

C: the density difference is at least 0.10 and less than 0.40

D: the density difference is at least 0.40

Evaluation of the Retransferability

A developing unit not containing developer was set into the black position; the developing voltage was adjusted to provide 0.6 mg/cm$^2$ for the laid-on level of the cyan toner to be evaluated; and image output was performed. The toner retransferred to the photosensitive member of the developing unit in the black position was taped and stripped off using a transparent polyester pressure-sensitive adhesive tape. The density difference was calculated by subtracting the density of only the pressure-sensitive adhesive tape pasted on paper from the density of the stripped-off pressure-sensitive adhesive tape pasted on the paper. An evaluation as indicated below was performed using the value of this density difference. The density was measured using the X-Rite color reflection densitometer referenced above.

A: the density difference is less than 0.05

B: the density difference is at least 0.05 and less than 0.10

C: the density difference is at least 0.10 and less than 0.40

D: the density difference is at least 0.40

Example 2 to Example 12

Toners were produced by the same method as in Example 1, but changing, as shown in Table 1, the conditions for addition of the hydrolysis solution in the "Polymerization Step" and the holding time post-addition. The pH adjustment of the slurry was performed with hydrochloric acid and an aqueous sodium hydroxide solution. The same evaluations as in Example 1 were performed on the obtained toners. The results of the evaluations are given in Tables 3 and 4.

Example 13 to Example 35

Toners were produced by carrying out external addition as indicated in Table 2 on the toner particle 1 obtained in Example 1. The external addition method was as follows: 100 parts of the toner particle and the external additive in the number of parts indicated in Table 2 were introduced into a SUPERMIXER PICCOLO SMP-2 (Kawata Mfg. Co., Ltd.) and mixing was performed for 10 minutes at 3,000 rpm. The same evaluations as in Example 1 were performed on the obtained toners. The results of the evaluations are given in Tables 3 and 4.

Example 36 to Example 41

Toners were produced by the same method as in Example 1, but changing, as shown in Table 1, the organosilicon compound for the surface layer used in the "Step of Hydrolyzing the Organosilicon Compound for the Surface Layer". The same evaluations as in Example 1 were performed on the obtained toners. The results of the evaluations are given in Tables 3 and 4.

Example 42 to Example 46

Toners were produced by the same method as in Example 1, but changing, as shown in Table 1, the conditions during the addition of the hydrolysis solution in the "Polymerization Step". The same evaluations as in Example 1 were performed on the obtained toners. The results of the evaluations are given in Tables 3 and 4.

Comparative Example 1, Comparative Example 2

Toners were produced by the same method as in Example 1, but changing, as shown in Table 1, the conditions during the addition of the hydrolysis solution in the "Polymerization Step" and the holding time post-addition. The same evaluations as in Example 1 were performed on the obtained toners. The results of the evaluations are given in Tables 3 and 4.

Comparative Example 3

The "Step of Hydrolyzing the Organosilicon Compound for the Surface Layer" was not performed. Instead, 8 parts of methyltriethoxysilane, which was the organosilicon compound for the surface layer, was added as such as monomer in the "Polymerizable Monomer Composition Preparation Step".

In the "Polymerization Step", the hydrolysis solution addition was not performed after cooling to 70° C. and measurement of the pH. The surface layer was formed by simply continuing to stir at 70° C., adjusting the slurry to pH=9.0 using an aqueous sodium hydroxide solution in order to complete the condensation, and holding for an additional 300 minutes.

Except for this, the toner was produced by the same method as in Example 1. The same evaluations as in Example 1 were performed on the obtained toner. The results of the evaluations are given in Tables 3 and 4.

Comparative Example 4

The methyltriethoxysilane added in the "Polymerizable Monomer Composition Preparation Step" in Comparative Example 3 was changed to 15 parts.

Other than this, the toner was produced by the same method as in Comparative Example 3. The same evaluations as in Example 1 were performed on the obtained toner. The results of the evaluations are given in Tables 3 and 4.

Comparative Example 5

The methyltriethoxysilane added in the "Polymerizable Monomer Composition Preparation Step" in Comparative Example 3 was changed to 30 parts.

Other than this, the toner was produced by the same method as in Comparative Example 3. The same evaluations as in Example 1 were performed on the obtained toner. The results of the evaluations are given in Tables 3 and 4.

Comparative Example 6

Binder Resin 1 Production Example

| | |
|---|---|
| Terephthalic acid | 25.0 mol % |
| Adipic acid | 13.0 mol % |
| Trimellitic acid | 8.0 mol % |
| Propylene oxide-modified bisphenol A (2.5 mol adduct) | 33.0 mol % |
| Ethylene oxide-modified bisphenol A (2.5 mol adduct) | 21.0 mol % |

A total of 100 parts of the acid components and alcohol components indicated above and 0.02 parts of tin 2-ethylhexanoate as esterification catalyst were introduced into a four-neck flask; a pressure-reduction apparatus, water-separation apparatus, nitrogen gas introduction apparatus, temperature measurement apparatus, and stirrer were installed; and the temperature was raised to 230° C. under a nitrogen atmosphere and a reaction was run. After the completion of the reaction, the product was removed from the flask and was cooled and pulverized to obtain the binder resin 1.

Binder Resin 2 Production Example

Binder resin 2 was produced by the same method as for binder resin 1, but changing the monomer composition ratio and the reaction temperature as follows.

| | |
|---|---|
| Terephthalic acid | 50.0 mol % |
| Trimellitic acid | 3.0 mol % |
| Propylene oxide-modified bisphenol A (2.5 mol adduct) | 47.0 mol % |
| Reaction temperature | 190° C. |

Comparative Toner 6 Production Example

Binder resin 1: 70.0 parts

Binder resin 2: 30.0 parts

Magnetic iron oxide particles: 90.0 parts (number-average particle diameter=0.14 μm, Hc=11.5 kA/m, σs=84.0 $Am^2/kg$, σr=16.0 $Am^2/kg$)

Fischer-Tropsch wax (melting point=105° C.): 2.0 parts

Charge control agent 1 (structural formula below): 2.0 parts

Charge Control Agent 1

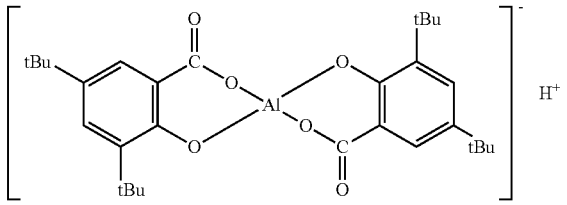

tBu in the formula represents the tert-butyl group.

Figure 3:
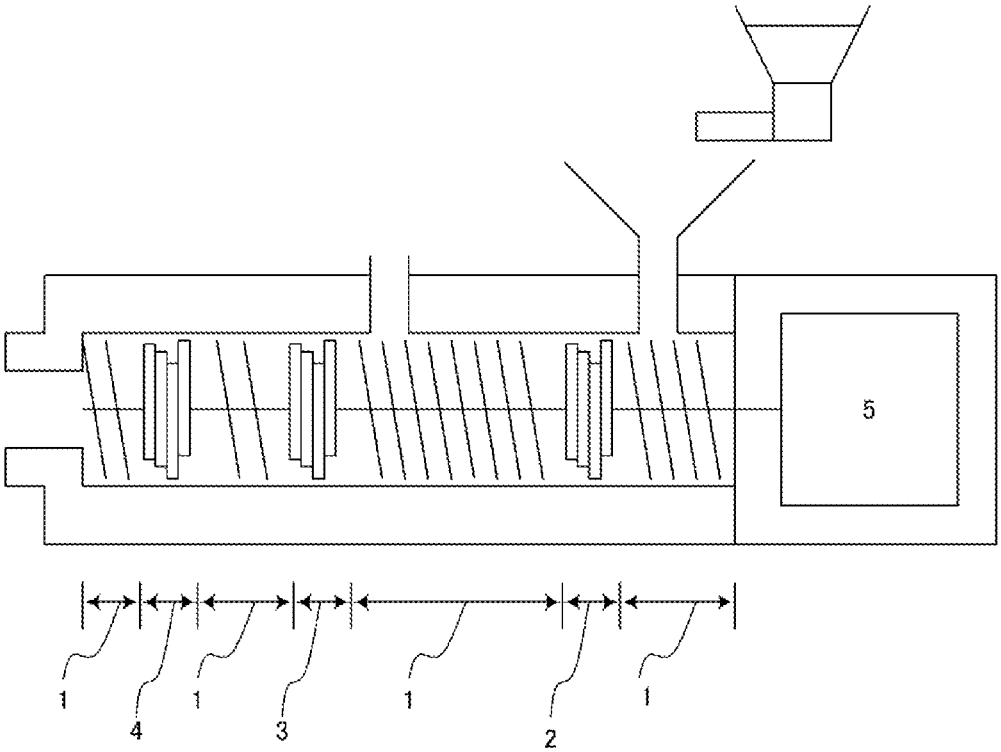
FIG. 3 is the twin-screw kneader-extruder used to produce comparative toner 6.

The aforementioned materials were pre-mixed with a Henschel mixer and were then melt-kneaded using the twin-screw kneader-extruder having three kneading sections and a screw section 1 as shown in FIG. 3. Melt-kneading was carried out using 110° C. for the heating temperature of the first kneading section, which was proximal to the supply port; 130° C. for the heating temperature of the second kneading section; 150° C. for the heating temperature of the third kneading section; and 200 rpm for the paddle rotation speed. The resulting kneaded material was cooled, coarsely pulverized with a hammer mill, and subsequently pulverized with a pulverizer using a jet stream, and the resulting finely pulverized powder was classified using a Coanda effect-based multi-grade classifier to obtain a toner particle having a weight-average particle diameter of 7.0 μm.

The reference signs in FIG. 3 are as follows.

1: screw section, 2: first kneading section, 3: second kneading section, 4: third kneading section, 5: motor 1.0 parts of a hydrophobic silica fine powder (BET=140 $m^2/g$, silane coupling treated and silicone oil treated, hydrophobicity=78%) and 3.0 parts of strontium titanate (D50=1.2 μm) were mixed with and externally added to 100 parts of the toner particle. This was followed by screening on a mesh with an aperture of 150 μm to obtain comparative toner 6. The same evaluations as in Example 1 were performed on the obtained toner. The results of the evaluations are given in Tables 3 and 4.

Comparative Example 7

The magnetic toner particle 1 described in the examples of Japanese Patent Application Laid-open No. 2015-45860 was produced. The magnetic body in the binder is present as ferrite, and the surface is a heat-treated material. The same evaluations as in Example 1 were performed on the obtained toner. The results of the evaluations are given in Tables 3 and 4.

Comparative Examples 8 and 9

Toners were produced by carrying out external addition as indicated in Table 2 on the toner particle obtained in Comparative Example 1. The external addition method was as follows: 100 parts of the toner particle and the external additive in the number of parts indicated in Table 2 were introduced into a SUPERMIXER PICCOLO SMP-2 (Kawata Mfg. Co., Ltd.) and mixing was performed for 10 minutes at 3,000 rpm. The same evaluations as in Example 1 were performed on the obtained toners. The results of the evaluations are given in Tables 3 and 4.

TABLE 1

| | | | | Conditions during addition of the hydrolysis solution | | | Conditions after addition of hydrolysis solution Holding time until pH |
|---|---|---|---|---|---|---|---|
| Example No. | A | B | Type of organosilicon compound for the surface layer | Slurry pH | Slurry temperature ° C. | C | adjustment for condensation completion(min) |
| 1 | 9.0 | 0.3 | Methyltriethoxysilane | 5.0 | 55 | 20 | 30 |
| 2 | 9.0 | 0.3 | Methyltriethoxysilane | 9.0 | 70 | 20 | 0 |
| 3 | 9.0 | 0.3 | Methyltriethoxysilane | 7.0 | 65 | 20 | 3 |
| 4 | 9.0 | 0.3 | Methyltriethoxysilane | 5.0 | 55 | 20 | 10 |
| 5 | 9.0 | 0.3 | Methyltriethoxysilane | 5.0 | 45 | 20 | 60 |
| 6 | 9.0 | 0.3 | Methyltriethoxysilane | 5.0 | 40 | 20 | 90 |
| 7 | 11.0 | 0 | Methyltriethoxysilane | 5.0 | 55 | 20 | 30 |
| 8 | 9.0 | 0 | Methyltriethoxysilane | 5.0 | 55 | 20 | 30 |
| 9 | 9.0 | 0.5 | Methyltriethoxysilane | 5.0 | 55 | 20 | 30 |
| 10 | 8.0 | 0.5 | Methyltriethoxysilane | 5.0 | 55 | 20 | 30 |
| 11 | 7.0 | 0.6 | Methyltriethoxysilane | 5.0 | 55 | 20 | 30 |
| 12 | 7.0 | 0.7 | Methyltriethoxysilane | 5.0 | 55 | 20 | 30 |
| 13-35 | | | | Same as in Example 1 | | | |
| 36 | 9.0 | 0.3 | Tetraethoxysilane | 5.0 | 55 | 20 | 30 |
| 37 | 9.0 | 0.3 | Dimethyldiethoxysilane | 5.0 | 55 | 20 | 30 |
| 38 | 9.0 | 0.3 | Trimethylethoxysilane | 5.0 | 55 | 20 | 30 |
| 39 | 9.0 | 0.3 | N-propyltriethoxysilane | 5.0 | 55 | 20 | 30 |
| 40 | 9.0 | 0.3 | Phenyltriethoxysilane | 5.0 | 55 | 20 | 30 |
| 41 | 9.0 | 0.3 | Hexyltriethoxysilane | 5.0 | 55 | 20 | 30 |
| 42 | 9.0 | 0.3 | Methyltriethoxysilane | 5.0 | 85 | 20 | 30 |
| 43 | 9.0 | 0.3 | Methyltriethoxysilane | 5.0 | 55 | 38 | 30 |
| 44 | 9.0 | 0.3 | Methyltriethoxysilane | 5.0 | 55 | 75 | 30 |
| 45 | 9.0 | 0.3 | Methyltriethoxysilane | 5.0 | 55 | 13 | 30 |
| 46 | 9.0 | 0.3 | Methyltriethoxysilane | 5.0 | 55 | 3 | 30 |
| Comparative 1 | 9.0 | 0.3 | Methyltriethoxysilane | 9.5 | 75 | 20 | 0 |
| Comparative 2 | 9.0 | 0.3 | Methyltriethoxysilane | 5.0 | 35 | 20 | 150 |
| Comparative 3 | 9.0 | 0.3 | Methyltriethoxysilane | Added in the dissolution step without hydrolysis, refer to text | | | |
| Comparative 4 | 9.0 | 0.3 | Methyltriethoxysilane | | | | |
| Comparative 5 | 9.0 | 0.3 | Methyltriethoxysilane | | | | |
| Comparative 6 | | | | Refer to text | | | |
| Comparative 7 | | | | | | | |
| Comparative 8 | 9.0 | 0.3 | Methyltriethoxysilane | 9.5 | 55 | 20 | 0 |
| Comparative 9 | 9.0 | 0.3 | Methyltriethoxysilane | 9.5 | 55 | 20 | 0 |

In Table 1, "A" indicates "Number of parts of addition of polymerization initiator", "B" indicates "Number of parts of addition of crosslinking agent", and "C" indicates "Number of parts of addition of the hydrolysis solution".

TABLE 2

| Toner No. | External additive | Content | external additive Particle diameter μm | parts | X (%) | Y (%) | Z (%) |
|---|---|---|---|---|---|---|---|
| 1-12 | | No external addition | | | | | |
| 13 | DHT-4A | Positively charged particle (hydrotalcite) | 0.4 | 0.2 | 9 | — | — |
| 14 | DHT-4A | Positively charged particle (hydrotalcite) | 0.08 | 0.2 | 12 | — | — |
| 15 | DHT-4A | Positively charged particle (hydrotalcite) | 0.11 | 0.2 | 13 | — | — |
| 16 | DHT-4A | Positively charged particle (hydrotalcite) | 0.25 | 0.2 | 10 | — | — |
| 17 | DHT-4A | Positively charged particle (hydrotalcite) | 0.76 | 0.2 | 7 | — | — |
| 18 | DHT-4A | Positively charged particle (hydrotalcite) | 0.95 | 0.2 | 5 | — | — |
| 19 | DHT-4A | Positively charged particle (hydrotalcite) | 1.12 | 0.2 | 4 | — | — |
| 20 | Epostar S | Positively charged particle | 0.3 | 0.2 | 10 | — | — |
| 21 | MP-2701 | Positively charged particle | 0.4 | 0.2 | 11 | — | — |
| 22 | DHT-4A | Positively charged particle (hydrotalcite) | 0.4 | 0.03 | 75 | — | — |
| 23 | DHT-4A | Positively charged particle (hydrotalcite) | 0.4 | 0.1 | 30 | — | — |
| 24 | DHT-4A | Positively charged particle (hydrotalcite) | 0.4 | 0.4 | 14 | — | — |
| 25 | DHT-4A | Positively charged particle (hydrotalcite) | 0.4 | 0.8 | 4 | — | — |
| 26 | DHT-4A | Positively charged particle (hydrotalcite) | 0.4 | 1.5 | 5 | — | — |
| 27 | DHT-4A | Positively charged particle (hydrotalcite) | 0.4 | 2.0 | 3 | — | — |
| 28 | UHP-S1 | Boron nitride | 0.6 | 0.01 | — | 99 | 95 |
| 29 | UHP-S1 | Boron nitride | 0.6 | 0.03 | — | 97 | 96 |
| 30 | UHP-S1 | Boron nitride | 0.6 | 0.05 | — | 95 | 94 |
| 31 | UHP-S1 | Boron nitride | 0.6 | 0.2 | — | 95 | 93 |
| 32 | UHP-S1 | Boron nitride | 0.6 | 0.5 | — | 89 | 88 |
| 33 | UHP-S1 | Boron nitride | 0.6 | 1.0 | — | 84 | 84 |
| 34 | UHP-S1 | Boron nitride | 0.6 | 2.0 | — | 80 | 83 |
| 35 | UHP-S1 | Boron nitride | 0.6 | 2.2 | — | 76 | 87 |
| 36-46 | | No external addition | | | | | |
| Comparative 1-7 | | No external addition | | | | | |
| Comparative 8 | DHT-4A | Positively charged particle (hydrotalcite) | 0.4 | 0.4 | 14 | — | — |
| Comparative 9 | UHP-S1 | Boron nitride | 0.6 | 0.2 | — | 95 | 50 |

In the table, the particle diameter of the external additive is the number-average particle diameter, and the number of parts of the external additive is the number of parts per 100 parts of the toner particle. DHT-4A is a product of Kyowa Chemical Industry Co., Ltd.; Epostar S is a product of Nippon Shokubai Co., Ltd.; MP2701 is a product of Soken Chemical & Engineering Co., Ltd.; and UHP-S1 is a product of Showa Denko K.K.

Also in Table 2, "X" indicates "Fixing ratio for the positively charged particle", "Y" indicates "Fixing ratio for the boron nitride" and "Z" indicates "Fixing ratio for the boron nitride after 4,000 prints post-replenishment".

TABLE 3

| Example No. | Martens hardness (Mpa) A | B | W (%) | Development slreaks | Ghosts | Cleaning performance | Charge rise: Initial Amount of charge (μC/g) | Rank | After 4,000 prints Amount of charge (μC/g) | Rank | 4,000 prints post-replenishment Amount of charge (μC/g) | Rank |
|---|---|---|---|---|---|---|---|---|---|---|---|---|
| 1 | 598 | 23 | 97 | A | A | A | −35.2 | B | −26.3 | C | −20.1 | C |
| 2 | 203 | 12 | 96 | C | C | A | −36.2 | B | −23.0 | C | — | — |
| 3 | 251 | 16 | 95 | B | B | A | −36.2 | B | −25.3 | C | — | — |
| 4 | 316 | 21 | 96 | A | A | A | −35.6 | B | −25.9 | C | — | — |
| 5 | 980 | 33 | 97 | B | A | A | −35.7 | B | −26.1 | C | — | — |
| 6 | 1092 | 42 | 95 | C | A | A | −35.7 | B | −25.8 | C | — | — |
| 7 | 536 | 3 | 96 | B | A | A | −36.5 | B | −26.1 | C | — | — |
| 8 | 562 | 5 | 95 | B | A | A | −36.6 | B | −26.9 | C | — | — |
| 9 | 606 | 53 | 96 | A | A | A | −35.2 | B | −25.9 | C | — | — |
| 10 | 618 | 78 | 96 | A | A | A | −35.1 | B | −25.4 | C | — | — |
| 11 | 623 | 99 | 95 | A | A | B | −36.2 | B | −26.1 | C | — | — |
| 12 | 633 | 111 | 96 | A | A | C | −35.7 | B | −26.2 | C | — | — |
| 13 | 598 | 23 | 97 | A | A | A | −60.0 | A | −45.0 | A | — | — |
| 14 | 598 | 23 | 97 | A | A | A | −63.0 | A | −50.0 | A | — | — |
| 15 | 598 | 23 | 97 | A | A | A | −58.0 | A | −42.0 | A | — | — |

TABLE 3-continued

| Example | Martens hardness (Mpa) | | W | Development | | Cleaning | Charge rise: Initial | | After 4,000 prints | | 4,000 prints post-replenishment | |
|---|---|---|---|---|---|---|---|---|---|---|---|---|
| No. | A | B | (%) | slreaks | Ghosts | performance | Amount of charge (μC/g) | Rank | Amount of charge (μC/g) | Rank | Amount of charge (μC/g) | Rank |
| 16 | 598 | 23 | 97 | A | A | A | −59.0 | A | −43.0 | A | — | — |
| 17 | 598 | 23 | 97 | A | A | A | −58.0 | A | −44.0 | A | — | — |
| 18 | 598 | 23 | 97 | A | A | A | −50.0 | A | −38.0 | B | — | — |
| 19 | 598 | 23 | 97 | A | A | A | −45.0 | A | −30.0 | C | — | — |
| 20 | 598 | 23 | 97 | A | A | A | −50.0 | A | −34.0 | B | — | — |
| 21 | 598 | 23 | 97 | A | A | A | −49.0 | A | −35.0 | B | — | — |
| 22 | 598 | 23 | 97 | A | A | A | −40.0 | B | −26.0 | C | — | — |
| 23 | 598 | 23 | 97 | A | A | A | −43.0 | A | −29.0 | C | — | — |
| 24 | 598 | 23 | 97 | A | A | A | −65.0 | A | −51.0 | A | — | — |
| 25 | 598 | 23 | 97 | A | A | A | −66.0 | A | −53.0 | A | — | — |
| 26 | 598 | 23 | 97 | A | A | A | −70.0 | A | −40.0 | B | — | — |
| 27 | 598 | 23 | 97 | A | A | A | −73.0 | A | −38.0 | B | — | — |
| 28 | 598 | 23 | 97 | A | A | A | −38.6 | B | −30.2 | B | −25.6 | C |
| 29 | 598 | 23 | 97 | A | A | A | −37.2 | B | −35.5 | B | −32.1 | B |
| 30 | 598 | 23 | 97 | A | A | A | −36.0 | B | −35.5 | B | −34.0 | B |
| 31 | 598 | 23 | 97 | A | A | A | −37.2 | B | −36.0 | B | −34.6 | B |
| 32 | 598 | 23 | 97 | A | A | A | −38.6 | B | −37.5 | B | −35.5 | B |
| 33 | 598 | 23 | 97 | A | A | A | −36.9 | B | −35.4 | B | −33.2 | B |
| 34 | 598 | 23 | 97 | A | A | A | −33.1 | B | −31.2 | B | −30.5 | B |
| 35 | 598 | 23 | 97 | A | A | A | −31.2 | B | −30.2 | B | −28.5 | C |
| 36 | 960 | 33 | 92 | B | A | A | −30.2 | B | −25.1 | C | — | — |
| 37 | 386 | 22 | 93 | A | A | A | −36.2 | B | −25.3 | C | — | — |
| 38 | 301 | 20 | 91 | A | A | A | −37.5 | B | −26.1 | C | — | — |
| 39 | 423 | 22 | 90 | A | A | A | −38.7 | B | −25.6 | C | — | — |
| 40 | 350 | 21 | 92 | A | A | A | −37.4 | B | −26.1 | C | — | — |
| 41 | 328 | 21 | 93 | A | A | A | −36.9 | B | −25.1 | C | — | — |
| 42 | 550 | 23 | 85 | B | B | A | −38.4 | B | −23.1 | C | — | — |
| 43 | 750 | 28 | 92 | A | A | A | −39.2 | B | −26.4 | C | — | — |
| 44 | 950 | 33 | 90 | B | A | A | −39.6 | B | −29.0 | C | — | — |
| 45 | 430 | 22 | 95 | A | A | A | −34.2 | B | −25.4 | C | — | — |
| 46 | 220 | 12 | 96 | C | C | A | −28.9 | C | −21.0 | C | — | — |
| Comparative 1 | 185 | 10 | 90 | D | D | A | −35.5 | B | −18.5 | D | — | — |
| Comparative 2 | 1200 | 50 | 91 | D | A | A | −36.2 | B | −15.0 | D | — | — |
| Comparative 3 | 89 | 50 | 89 | D | D | A | −36.9 | B | −15.5 | D | — | — |
| Comparative 4 | 185 | 70 | 88 | D | D | A | −37.1 | B | −18.3 | D | — | — |
| Comparative 5 | 153 | 150 | 85 | D | D | D | −35.4 | B | −19.2 | D | — | — |
| Comparative 6 | 43 | 51 | — | D | D | A | −38.2 | B | −18.6 | D | — | — |
| Comparative 7 | 186 | 50 | — | D | D | A | −37.8 | B | −20.3 | D | — | — |
| Comparative 8 | 185 | 10 | — | D | D | A | −42.1 | A | −18.6 | D | | |
| Comparative 9 | 185 | 10 | — | D | D | A | −32.4 | B | −15.2 | D | F | |

In Table 3, "A" indicates "Martens hardness at maximum load of $2.0\times10^{-4}$ N", "B" indicates "Martens hardness at maximum load of $9.8\times10^{-4}$ N", "W" indicates "Fixing ratio for the organosilicon polymer" and "F" indicates that "Flake off occurred and evaluation could not be performed".

TABLE 4

| Example | D roller Si amount: After 4,000 prints | | Transferability: After 4,000 prints | | Transferability: 4,000 prints post-replenishment | | Retransferability: After 4,000 prints | | Retransferability: 4,000 prints post-replenishment | |
|---|---|---|---|---|---|---|---|---|---|---|
| No. | atm % | Rank | | A~D | | A~D | | A~D | | A~D |
| 1 | 2.45 | B | 0.06 | B | 0.30 | C | 0.11 | C | 0.36 | C |
| 2 | 2.35 | B | 0.07 | B | — | — | 0.12 | C | — | — |
| 3 | 2.52 | B | 0.06 | B | — | — | 0.13 | C | — | — |
| 4 | 2.31 | B | 0.08 | B | — | — | 0.15 | C | — | — |
| 5 | 2.22 | B | 0.07 | B | — | — | 0.16 | C | — | — |
| 6 | 2.38 | B | 0.09 | B | — | — | 0.12 | C | — | — |
| 7 | 2.51 | B | 0.05 | B | — | — | 0.19 | C | — | — |
| 8 | 2.56 | B | 0.06 | B | — | — | 0.13 | C | — | — |
| 9 | 2.57 | B | 0.06 | B | — | — | 0.11 | C | — | — |
| 10 | 2.47 | B | 0.07 | B | — | — | 0.12 | C | — | — |
| 11 | 2.69 | B | 0.07 | B | — | — | 0.12 | C | — | — |

TABLE 4-continued

| Example | D roller Si amount | | Transferability | | | | Retransferability | | | |
|---|---|---|---|---|---|---|---|---|---|---|
| | After 4,000 prints | | After 4,000 prints | | 4,000 prints post-replenishment | | After 4,000 prints | | 4,000 prints post-replenishment | |
| No. | atm % | Rank | | A~D | | A~D | | A~D | | A~D |
| 12 | 2.21 | B | 0.07 | B | — | — | 0.13 | C | — | — |
| 13 | 2.35 | B | 0.02 | A | — | — | 0.03 | A | — | — |
| 14 | 2.49 | B | 0.01 | A | — | — | 0.11 | C | — | — |
| 15 | 2.36 | B | 0.03 | A | — | — | 0.07 | B | — | — |
| 16 | 2.40 | B | 0.02 | A | — | — | 0.04 | A | — | — |
| 17 | 2.43 | B | 0.01 | A | — | — | 0.03 | A | — | — |
| 18 | 2.23 | B | 0.02 | A | — | — | 0.06 | B | — | — |
| 19 | 2.35 | B | 0.03 | A | — | — | 0.10 | C | — | — |
| 20 | 2.38 | B | 0.02 | A | — | — | 0.04 | A | — | — |
| 21 | 2.42 | B | 0.02 | A | — | — | 0.04 | A | — | — |
| 22 | 2.41 | B | 0.05 | B | — | — | 0.13 | C | — | — |
| 23 | 2.46 | B | 0.04 | A | — | — | 0.07 | B | — | — |
| 24 | 2.43 | B | 0.01 | A | — | — | 0.04 | A | — | — |
| 25 | 2.39 | B | 0.02 | A | — | — | 0.03 | A | — | — |
| 26 | 2.46 | B | 0.02 | A | — | — | 0.06 | B | — | — |
| 27 | 2.45 | B | 0.05 | B | — | — | 0.13 | C | — | — |
| 28 | 1.32 | B | 0.05 | B | 0.12 | C | 0.05 | B | 0.12 | C |
| 29 | 0.83 | A | 0.06 | B | 0.06 | B | 0.06 | B | 0.09 | B |
| 30 | 0.45 | A | 0.05 | B | 0.07 | B | 0.07 | B | 0.08 | B |
| 31 | 0.46 | A | 0.07 | B | 0.06 | B | 0.08 | B | 0.08 | B |
| 32 | 0.48 | A | 0.06 | B | 0.08 | B | 0.07 | B | 0.08 | B |
| 33 | 0.46 | A | 0.06 | B | 0.09 | B | 0.06 | B | 0.09 | B |
| 34 | 0.41 | A | 0.06 | B | 0.08 | B | 0.05 | B | 0.09 | B |
| 35 | 0.46 | A | 0.06 | B | 0.11 | C | 0.06 | B | 0.13 | C |
| 36 | 2.56 | B | 0.07 | B | — | — | 0.10 | C | — | — |
| 37 | 2.38 | B | 0.08 | B | — | — | 0.12 | C | — | — |
| 38 | 2.48 | B | 0.08 | B | — | — | 0.13 | C | — | — |
| 39 | 2.47 | B | 0.06 | B | — | — | 0.11 | C | — | — |
| 40 | 2.46 | B | 0.09 | B | — | — | 0.12 | C | — | — |
| 41 | 2.51 | B | 0.09 | B | — | — | 0.13 | C | — | — |
| 42 | 3.56 | C | 0.18 | C | — | — | 0.19 | C | — | — |
| 43 | 2.87 | B | 0.09 | B | — | — | 0.13 | C | — | — |
| 44 | 2.98 | B | 0.13 | C | — | — | 0.17 | C | — | — |
| 45 | 2.21 | B | 0.08 | B | — | — | 0.14 | C | — | — |
| 46 | 2.01 | B | 0.19 | C | — | — | 0.19 | C | — | — |
| Comparative 1 | 2.46 | B | 0.21 | C | — | — | 0.24 | C | — | — |
| Comparative 2 | 2.54 | B | 0.09 | B | — | — | 0.20 | C | — | — |
| Comparative 3 | 3.06 | C | 0.31 | C | — | — | 0.34 | C | — | — |
| Comparative 4 | 3.54 | C | 0.24 | C | — | — | 0.33 | C | — | — |
| Comparative 5 | 5.54 | D | 0.21 | C | — | — | 0.31 | C | — | — |
| Comparative 6 | — | — | 0.23 | C | — | — | 0.35 | C | — | — |
| Comparative 7 | — | — | 0.20 | C | — | — | 0.31 | C | — | — |
| Comparative 8 | 2.54 | B | 0.38 | C | — | — | 0.32 | C | — | — |
| Comparative 9 | 2.54 | B | 0.46 | D | 0.51 | D | 0.46 | D | 0.50 | D |

As is clear from Tables 3 and 4, "Examples 1 to 46", which are toners according to the present invention, maintain a better charge rise than in "Comparative Examples 1 to 9" even in a system having a modified process design. Thus, a toner can be provided that—even when the rotation speed of the developing roller is increased and high-speed continuous printing is carried out at high print percentages—exhibits an excellent charge rise and resists the occurrence of streaks and ghosts.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-96544, filed May 15, 2017, Japanese Patent Application No. 2017-96534, filed May 15, 2017, and Japanese Patent Application No. 2017-96504, filed May 15, 2017, which are hereby incorporated by reference herein in their entirety.

What is claimed is:

1. A toner comprising a toner particle that contains a binder resin and a colorant, wherein the toner has a Martens hardness, as measured at a maximum load condition of $2.0\times10^{-4}$ N, of from 200 MPa to 1,100 MPa.

2. The toner according to claim 1, wherein the toner has a Martens hardness, as measured at a maximum load condition of $9.8\times10^{-4}$ N, of from 5 MPa to 100 MPa.

3. The toner according to claim 1, wherein the toner particle has a surface layer containing an organosilicon polymer, and the number of carbon atoms directly bonded to the silicon atom in the organosilicon polymer is on average from 1 to 3 per silicon atom.

4. The toner according to claim 3, wherein a fixing ratio of the organosilicon polymer is at least 90%.

5. The toner according to claim 3, wherein the organosilicon polymer has a substructure represented by formula (1)

$$R—SiO_{3/2} \quad \text{formula (1)}$$

(R represents a hydrocarbon group having from 1 to 6 carbons).

6. The toner according to claim 5, wherein R is a hydrocarbon group having from 1 to 3 carbons.

7. The toner according to claim 1, wherein the toner particle has a positively charged particle on the surface thereof, and the number-average particle diameter of the positively charged particle is from 0.10 μm to 1.00 μm.

8. The toner according to claim 7, wherein a fixing ratio of the positively charged particle to the toner particle is from 5% to 75%.

9. The toner according to claim 1, wherein the toner particle has a hydrotalcite on the surface thereof.

10. The toner according to claim 1, wherein the toner particle has boron nitride on the surface thereof.

11. The toner according to claim 10, wherein a fixing ratio of the boron nitride to the toner particle is at least 80%.

* * * * *